US006174126B1

(12) United States Patent
Zanzig et al.

(10) Patent No.: US 6,174,126 B1
(45) Date of Patent: Jan. 16, 2001

(54) ARTICULATED REFUSE COLLECTION APPARATUS AND METHOD

(75) Inventors: Jerald G. Zanzig, Signal Mountain, TN (US); Marcel G. Stragier; John W. Pickrell, both of Scottsdale, AZ (US)

(73) Assignee: The Heil Co., Chattanooga, TN (US)

( * ) Notice: Under 35 U.S.C. 154(b), the term of this patent shall be extended for 0 days.

(21) Appl. No.: 09/149,513

(22) Filed: Sep. 8, 1998

Related U.S. Application Data

(63) Continuation of application No. 08/855,384, filed on May 13, 1997, now Pat. No. 5,813,824.

(51) Int. Cl.[7] ..... B65F 3/00
(52) U.S. Cl. ..... 414/809; 414/408; 414/812
(58) Field of Search ..... 414/406, 408, 414/471, 482, 483–487, 809, 810–812; 298/20 A, 22 AE

(56) References Cited

U.S. PATENT DOCUMENTS 2,020,231 * 11/1935 Bell .
4,589,670 * 5/1986 Sweetin ..... 414/483 X
4,674,942 * 6/1987 Assh et al. ..... 414/486 X
4,934,896 * 6/1990 Quinto ..... 414/408 X
5,551,824 * 9/1996 Zanzig et al. ..... 414/408
5,813,824 * 9/1998 Zanzig et al. ..... 414/408 X
5,871,330 * 2/1999 Davenport ..... 414/482 X

* cited by examiner

*Primary Examiner*—Stephen T. Gordon
(74) *Attorney, Agent, or Firm*—Parson & Goltry; Robert A. Parsons; Michael W. Goltry

(57) ABSTRACT

A refuse collection vehicle including a collection towing vehicle having a refuse loading mechanism for loading a semi-trailer coupled to a fifth wheel, the semi-trailer having a refuse collection body for receiving refuse from the refuse loading mechanism and a hoist mechanism for tilting the refuse collection body. The refuse collection system also includes a refuse transport vehicle which includes a transport towing vehicle having a fifth wheel for receiving a semi-trailer, and a dolly which may be coupled to the semi-trailer for towing additional semi-trailers. A control assembly is coupled to the refuse collection vehicle and the transport towing vehicle including the dolly, having control couplings for interconnection of control assemblies and control umbilicals for providing control to the various devices.

6 Claims, 17 Drawing Sheets

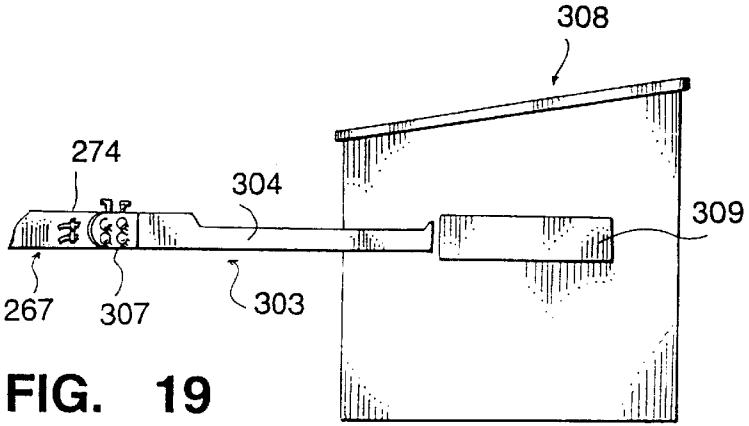
FIG. 19
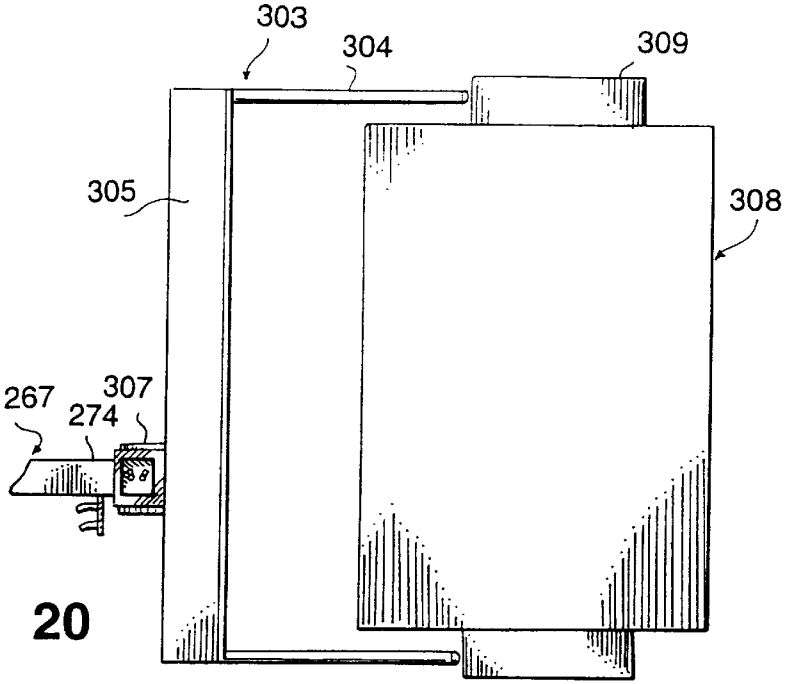
FIG. 20
FIG. 17
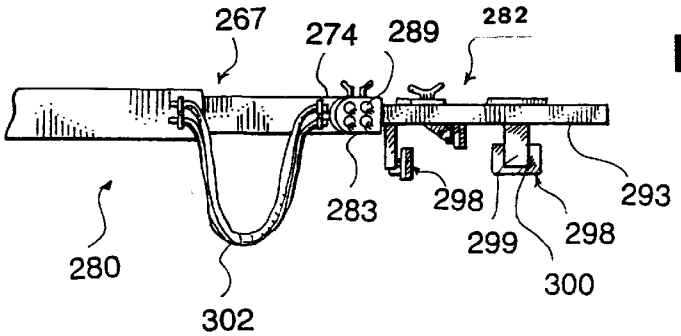
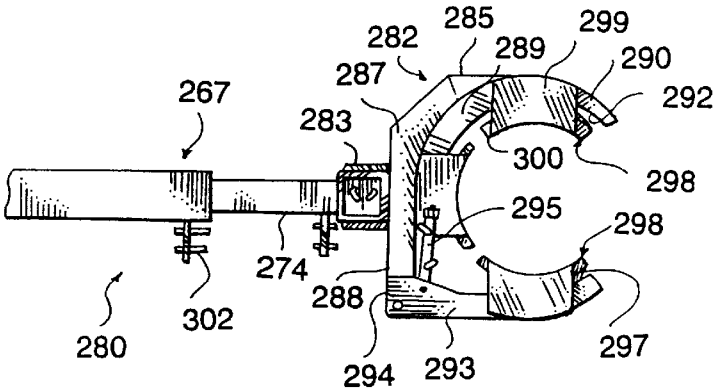
FIG. 18

FIG. 21
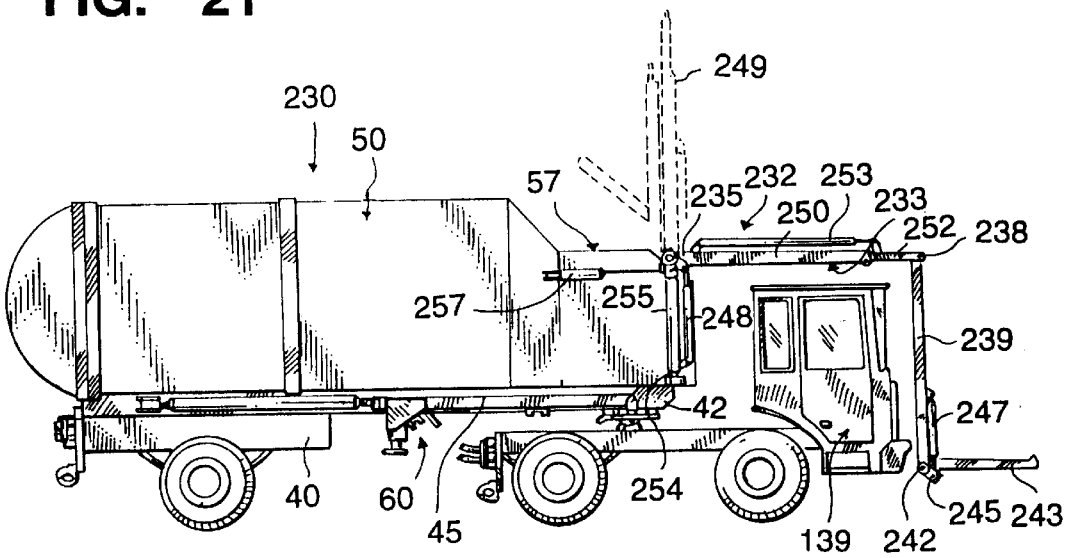
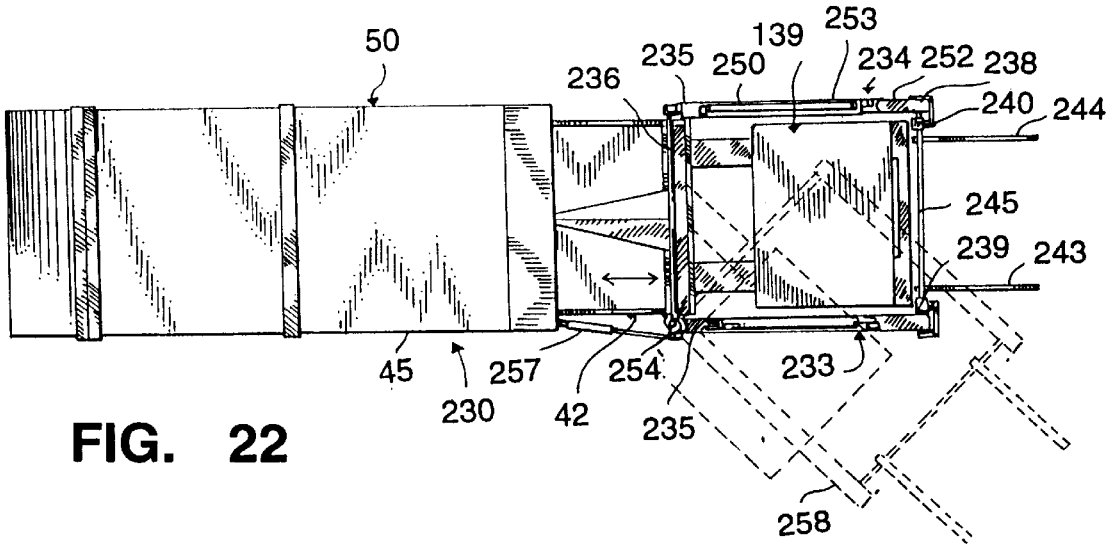
FIG. 22

FIG. 24
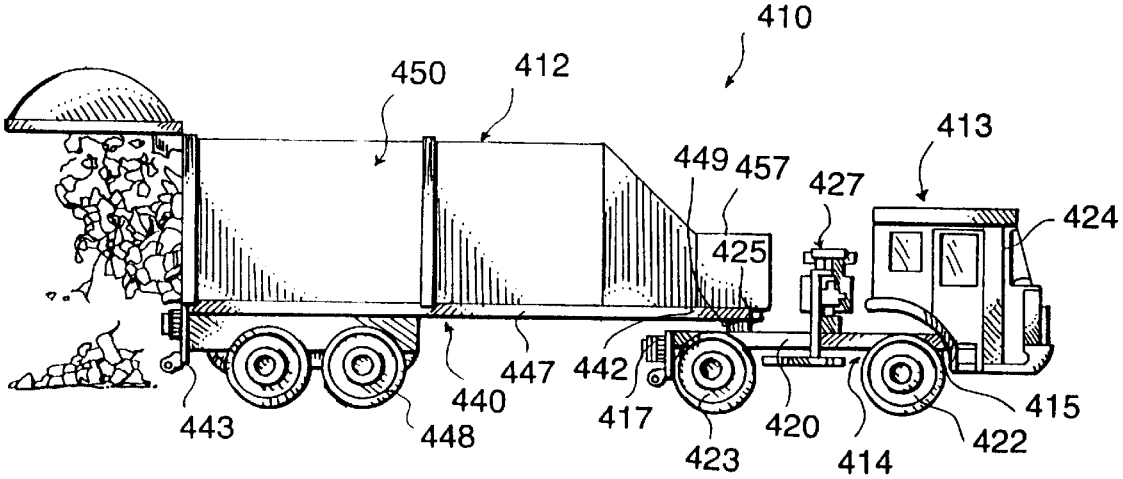
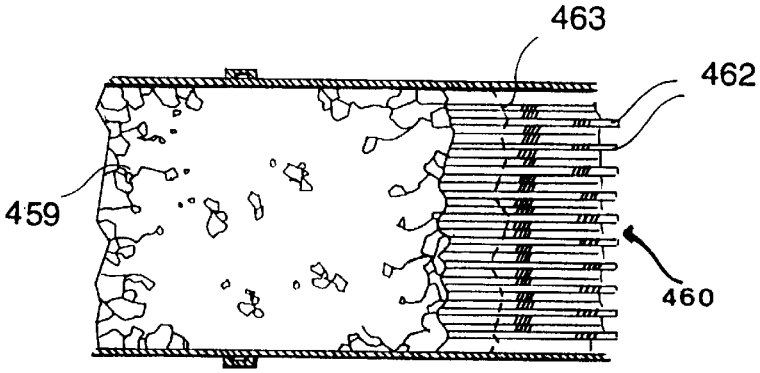
FIG. 25
FIG. 26
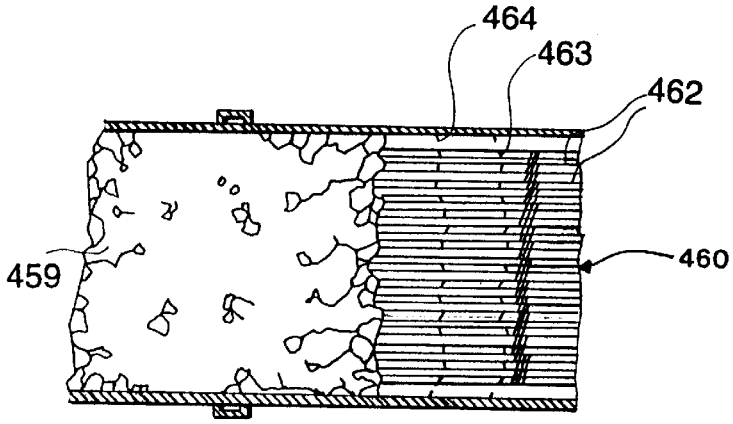

ARTICULATED REFUSE COLLECTION APPARATUS AND METHOD

This application is a continuation of application Ser. No. 08/855,384, filed May 13, 1997 and now U.S. Pat. No. 5,813,824.

BACKGROUND OF THE INVENTION

1. Field of the Invention

This invention relates to a refuse collection apparatus.

More particularly, the present invention relates to an articulated refuse collection vehicle.

In a further and more specific aspect, the present invention concerns the use of an articulated refuse collection vehicle in a refuse collection system.

2. Prior Art

The collection and removal of refuse, the solid waste of a community, is a major municipal problem. For example, residential refuse is generated at an average rate of approximately two pounds per day per capita. Other wastes, from commercial or industrial generators, typically add another pound. As accumulated, loose and uncompacted, the refuse has a density generally in the range of 50 to 300 pounds per cubic yard. For the health and welfare of the community, regular disposal is imperative.

Traditionally, residential refuse, including garbage, trash, and other waste materials were amassed and stored in containers of approximately 10 to 30 gallon capacity. On a regular basis, usually once or twice weekly, the containers were placed by the householder at a designated location for handling by the scheduled collection agency. Frequently designated locations were curb side and alley line. Not uncommonly, the refuse of a single residence, depending upon the number of occupants and the frequency of service, would occupy two or more containers, each weighing as much as 75 to 100 pounds. Commercial or industrial generators accumulated waste in larger, heavier containers.

Conventionally, these refuse containers were emptied into a refuse collection vehicle which transported the refuse to a disposal site. Disposal sites could be landfills, dumps, incinerators, et. cetera. The conventional refuse collection method involved a mechanized unit supplemented with manual labor. The mechanized unit, or collection vehicle, included a refuse handling body mounted upon a truck chassis. Generally, the vehicle was attended by a crew of three or more. One of the crew, the driver, attended to operation of the vehicle while the others, known as collectors, brought the refuse to the vehicle.

Commonly, the vehicle included a hopper of conveniently low loading height into which the collectors emptied the containers. Means were provided for transferring and compacting the refuse from the hopper into the body. The body also included unloading means for ejecting the refuse at the disposal site.

Recently, considerable effort has been devoted to developing devices which increase the speed and efficiency with which refuse is collected. The current efforts are primarily directed towards automation of the collection process. These devices generally employ a self-loading device which engages, lifts, and dumps refuse containers into the refuse handling body. A wide variety of self-loading devices have been developed and are in current use. These include side mounted arms and front loading arms. The use of these devices greatly increases the rate of collection.

While these self-loading devices greatly increase the rate at which refuse is collected, they fail to address pressing problems generated by increasing population, health concerns, and the increase in refuse volumes. Generally, these problems revolve around the transportation of the collected refuse. At this time, refuse can be collected faster and easier than at any other time in history, however, disposal of this collected waste is an ever growing problem.

Typically, refuse is transported to a landfill for disposal. It is common for landfills to be located a significant distance from the collection area. This is especially true for large communities. The distance refuse must be transported is growing quickly as relatively nearby landfills are filled, and as regulations limit the number of available sites requiring the use of more distant landfills.

A major problem with transporting refuse to a distantly located landfill is the increased cost generated by the need to employ a highly specialized vehicle, developed for refuse collection, to haul refuse a great distance. A refuse collection vehicle is very specialized, requiring heavy and expensive equipment. As the amount and weight of equipment used increases, to increase the speed and efficiency with which refuse is collected, the amount of refuse an individual truck can carry is reduced. This means the cost of collecting each pound of refuse is increased due to a reduced payload, increased cost of the vehicle, and time spent transporting refuse instead of collecting it.

Innovators are attempting to deal with the necessity of transporting refuse a great distance, and several options have be en developed. Trucks having a large carrying capacity are being produced. This approach, however, leads to an expensive truck which is relatively difficult to maneuver, reducing collection efficiency. A large refuse collection vehicle will lose time maneuvering and remaneuvering in order to reach a refuse container in a tight spot. This somewhat reduces the efficiency attained by the automated loading mechanism.

While the larger vehicles are capable of carrying a big load, all of the expensive, specialized equipment is inactive much of the time, and is actually a hindrance during transportation. The engine on the vehicle must also be correspondingly larger to transport the heavy loads to a distant disposal site, adding to weight and expense of the vehicle. Simply increasing the size of the refuse carrying body carried by the truck chassis does not prevent the automatic loading mechanism from being idle while in transport. This is inefficient, wasting valuable collection time of expensive equipment.

In an attempt to eliminate the use of collection equipment for transportation of refuse to a disposal site, the use of transfer stations has been developed. Transfer stations are generally large shed-like structures located centrally of a collection area. Refuse collection vehicles collect a load, and travel a short distance to this central location where they deposit the refuse. The deposited refuse is then loaded into transportation vehicles generally consisting of large open-topped tractor trailer rigs. Large expensive machinery transfers the deposited refuse into the transportation vehicles. These vehicles lacking the heavy self-loading mechanisms and built for long hauls, efficiently transport large volumes of material to distant disposal sites. Transfer stations allow refuse collection vehicles to make additional collection trips since very little time has been used transporting the refuse to the transfer station.

While this development releases collection equipment from the need to transport refuse a great distance, it does require a very expensive structure in a central location. Transfer stations require a large area in a conveniently located area easily accessible by large transport vehicles and refuse collection vehicles. Locations for transfer stations may be difficult to obtain due to opposition by local property owners, city ordinances or other factors. Furthermore, transfer stations are large expensive structures requiring a large expenditure for start-up.

It would be highly advantageous, therefore, to remedy the foregoing and other deficiencies inherent in the prior art.

Accordingly, it is an object of the present invention to provide a new and improved refuse collection apparatus and system.

Another object of the present invention is to provide a refuse collection system which will permit efficient use of time and equipment.

And another object of the present invention is to provide a refuse collection system which is flexible and will meet substantially any requirements of a community, accommodating refuse from individual households, from larger commercial generators or for even larger commercial or industrial generators.

Still another object of the present invention is to provide a refuse collection vehicle which is articulated to maintain maneuverability while carrying a large payload.

Yet another object of the present invention is to provide a refuse collection vehicle which has a semi-trailer refuse carrier which may be used to collect and transport refuse.

Yet still another object of the present invention is to provide a refuse vehicle having a semi-trailer which may be interchangeable between a collection towing vehicle, having a refuse collecting device, and a transport towing vehicle for transporting the trailer to distant disposal sites.

And a further object of the present invention is to provide a semi-trailer having a hoist which can dump refuse while attached to a towing vehicle or in tandem, coupled to a dolly.

Yet a further object of the present invention is to provide an articulated refuse collection vehicle which can grab and dump a refuse container that is essentially at any angle relative the semi-trailer.

And yet a further object of the present invention is to provide a refuse collection system which does not require an expensive transfer station while still transporting refuse a great distance to a disposal site, collecting and disposing of a large volume of refuse, and employing a minimum of equipment.

It is a further object of the present invention to provide a system in which interchangeable bodies or bodies on semi-trailers may be parked or stored either filled or empty to be serviced by a multiplicity of collection and transport vehicles.

It is a further object of the present invention to provide a system in which interchangeable semi-trailers may be hauled individually or in tandem as a set of doubles.

SUMMARY OF THE INVENTION

Briefly, to achieve the desired objects of the instant invention in accordance with a preferred embodiment thereof, provided is a refuse collection system which includes a semi-trailer having a refuse collection body with a tailgate assembly, a hopper, a compacter for moving refuse from the hopper to a storage area, and a hoist for tilting the body to dump the collected refuse. A coupling assembly pivotally couples the semi-trailer to a collection tow vehicle having a fifth wheel and a loader assembly, for collecting refuse, and a transport tow vehicle, having a fifth wheel, for towing the semi-trailer to a disposal site.

Also provided is a dolly having a fifth wheel for receiving the semi-trailer coupling assembly. The dolly may be coupled behind a semi-trailer for tandem towing of two semi-trailers.

A control assembly having a control umbilical with the necessary conduits for operating the various functions of the refuse collection vehicle is provided. A control coupling assembly interconnecting control umbilical of individual vehicles, consists of a male control coupling member at one end, and a female control coupling member at the opposite end. The control assembly permits control and operation of a semi-trailer coupled to a collection tow vehicle, a transport tow vehicle, and a dolly.

The refuse collection system allows for specialized loading equipment attached to the collection tow vehicle to load a semi-trailer during a collection process. The semi-trailer is then switched to a transport tow vehicle for transporting the refuse to a disposal site. This frees the collection tow vehicle, having costly refuse loading equipment, to load additional trailers. The transport tow vehicle may tow additional semi-trailers by the attachment of the dolly to the back of the first towed semi-trailer. Additional semi-trailers may be coupled to the dolly. The control assembly allows dumping of refuse from the semi-trailer coupled to the dolly.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which:

FIG. 17 is a side view of a lifting attachment which may be used on the pivotal loading arm illustrated in FIGS. 14 and 15;

FIG. 18 is a top view of an embodiment of the lifting attachment illustrated in FIG. 16;

FIG. 19 is an alternate embodiment of the lifting attachment to the pivotal loading arm illustrated in FIGS. 14 and 15;

FIG. 20 is a top view of the alternate embodiment of the lifting attachment illustrated in FIG. 18;

FIG. 21 is a refuse collection vehicle consisting of a semi-trailer having a pivot al front loader coupled thereto, towed by a transport tow vehicle;

FIG. 22 is a top view of the refuse collection vehicle illustrated in FIG. 20;

FIG. 24 is a side view of a further embodiment of an articulated refuse collection apparatus;

FIGS. 25 and 26 are fragmentary top views of a walking floor;

DETAILED DESCRIPTION OF THE PREFERRED EMBODIMENT

Figure 1:
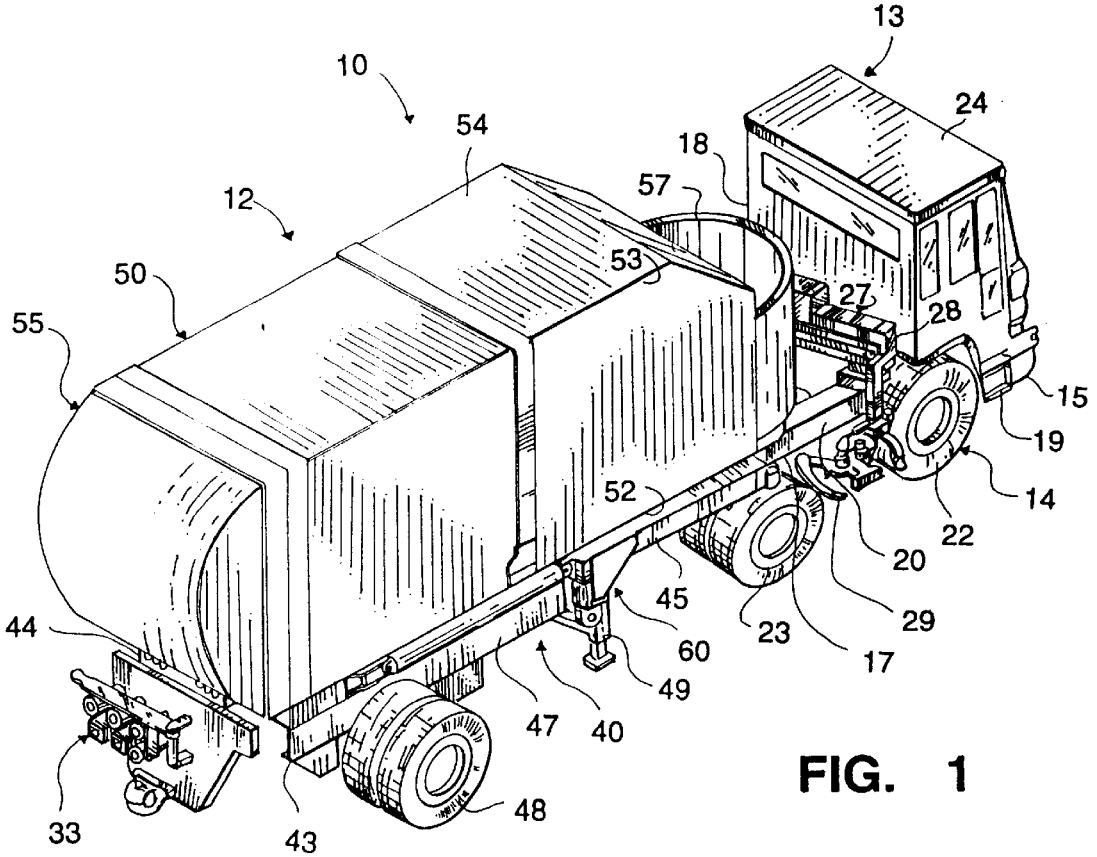
FIG. 1 is a perspective view of an articulated refuse collection vehicle consisting of a semi-trailer coupled to a collection tow vehicle constructed in accordance with the teachings of the instant invention.

Turning now to the drawings in which like reference characters indicate corresponding elements throughout the several views, attention is first directed to FIG. 1 which illustrates an articulated refuse collection vehicle generally designated by the reference character 10. Articulated refuse vehicle 10 consists of a semi-trailer 12 and a collection towing vehicle 13.

Collection towing vehicle 13 includes a chassis 14, which, for purposes of orientation in the ensuing discussion, is considered to have a forward end 15 a rearward end 17, a left or street side 18 and a right or curb side 19. Chassis 14 includes a frame 20 supported above ground level by front wheels 22 and rear wheels 23. In accordance with conventional practice, front wheels 22 being steerable, provide directional control for the vehicle. Similarly, rear wheels 23 are caused to rotate in response to a conventional engine, transmission and drive train, not specifically illustrated, for propulsion of the unit. A cab 24, carried at forward end 15 of frame 20 provides for an enclosed driver's compartment including the conventional controls associated with the manipulation of the chassis as well as conventional controls associated with the loading and compacting equipment. A fifth wheel assembly 25 is carried at rearward end 17 of frame 20. Fifth wheel 25 may be any conventional design well known to those skilled in the art, used in association with a semi-trailer.

A refuse loading mechanism generally designated 27 is carried by frame 20 intermediate cab 24 and fifth wheel assembly 25. In this preferred embodiment, refuse loading mechanism 27 consists of an extendable sidearm 28 terminating in a gripping member 29. Those skilled in the art will understand that various different types and designs of refuse loading mechanisms may be mounted on frame 20 for collection of refuse. Additional embodiments will be discussed below.

Various control media such as hydraulic, pneumatic, and electrical are conventionally supplied to various equipment by control conduits not specifically illustrated. The control medium are supplied to the various attachments such as semi-trailer 12, by a control assembly 30, consisting of an umbilical 32 made up of the individual conduits. Umbilical 32 has a female control coupling member 33 attached to one end, and a male control coupling member 34 attached to the opposite end. Control assembles 30 are interconnected by control couplings 35, which are male control coupling members 34 of one control assembly removably coupled to the female control coupling member 33 of a second control assembly. A female control coupling member 33 is carried by frame 20 at the rearward end 17. Control coupling 35 will be discussed in greater detail below.

Figure 2:
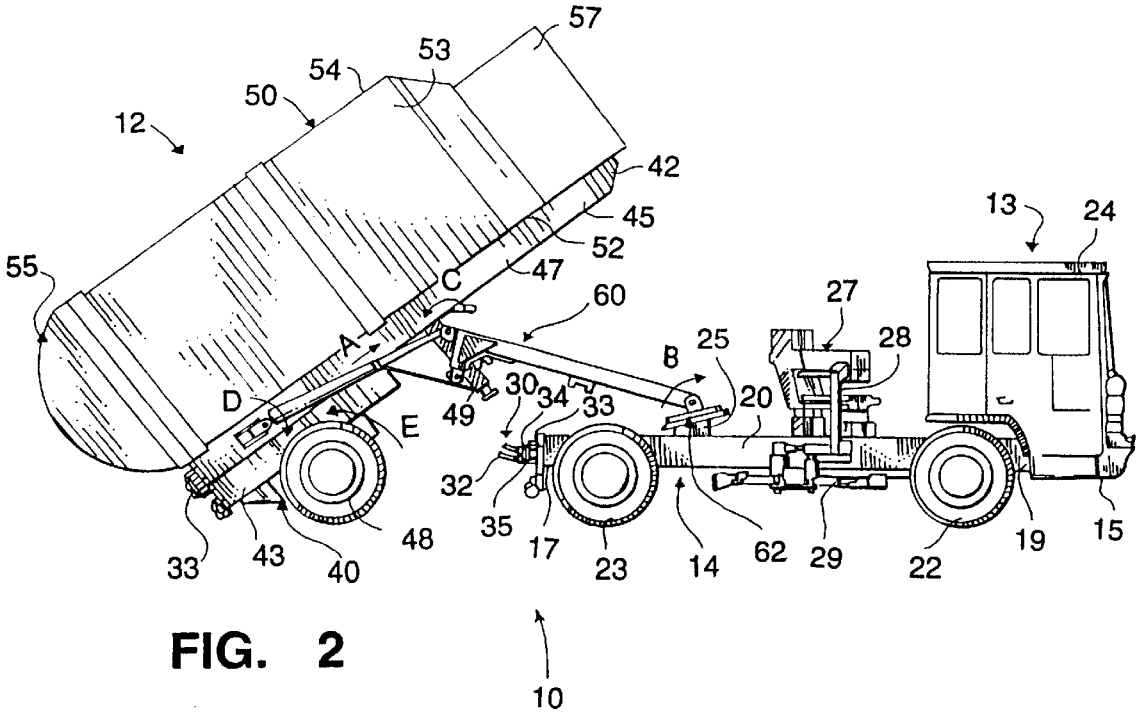
FIG. 2 is a side view of the refuse collection vehicle illustrated in FIG. 1 with the semi-trailer in the dump position.

Still referring to FIGS. 1 and 2, semi-trailer 12 includes a trailer chassis 40, which, for purposed of orientation is considered to have a forward end 42, a rearward end 43, a left or street side 44, and a right or curb side 45. Trailer chassis 40 includes a frame 47 supported above ground level by rear wheels 48 and landing gear 49 carried intermediate forward end 42 and rearward end 43 of frame 47.

A refuse collection body, generally designated by the referenced character 50 is carried upon chassis 40. Refuse collection body 50 is a hollow refuse receiving and storage receptacle generally defined by a bottom or lower horizontal panel 52, a pair of spaced apart upright side panels 53 (only one herein specifically illustrated), and a top or upper horizontal panel 54. At rearward end 43, the receptacle is normally closed by a tailgate assembly 55.

An arcuate hopper 57 is formed integral with the forward portion of refuse collection body 50 proximate forward end 42. Refuse, received by hopper 57 from refuse loading mechanism 27, is moved from hopper 57 to the storage receptacle by a rotating compacter mechanism 58, or swinging platten, coupled to a pivot point within hopper 57 and rotating about a vertical axis, as can be seen with further reference to FIG. 6.

Semi-trailer 12 also includes a hoist mechanism 60 having an end pivotally coupled to frame 47, and an opposing end terminating in a coupling assembly 62 including a king pin not visible, which is received by fifth wheel assembly 25 of collection tow vehicle 13. Hoist mechanism 60 will be discussed in greater detail below.

Figure 6:
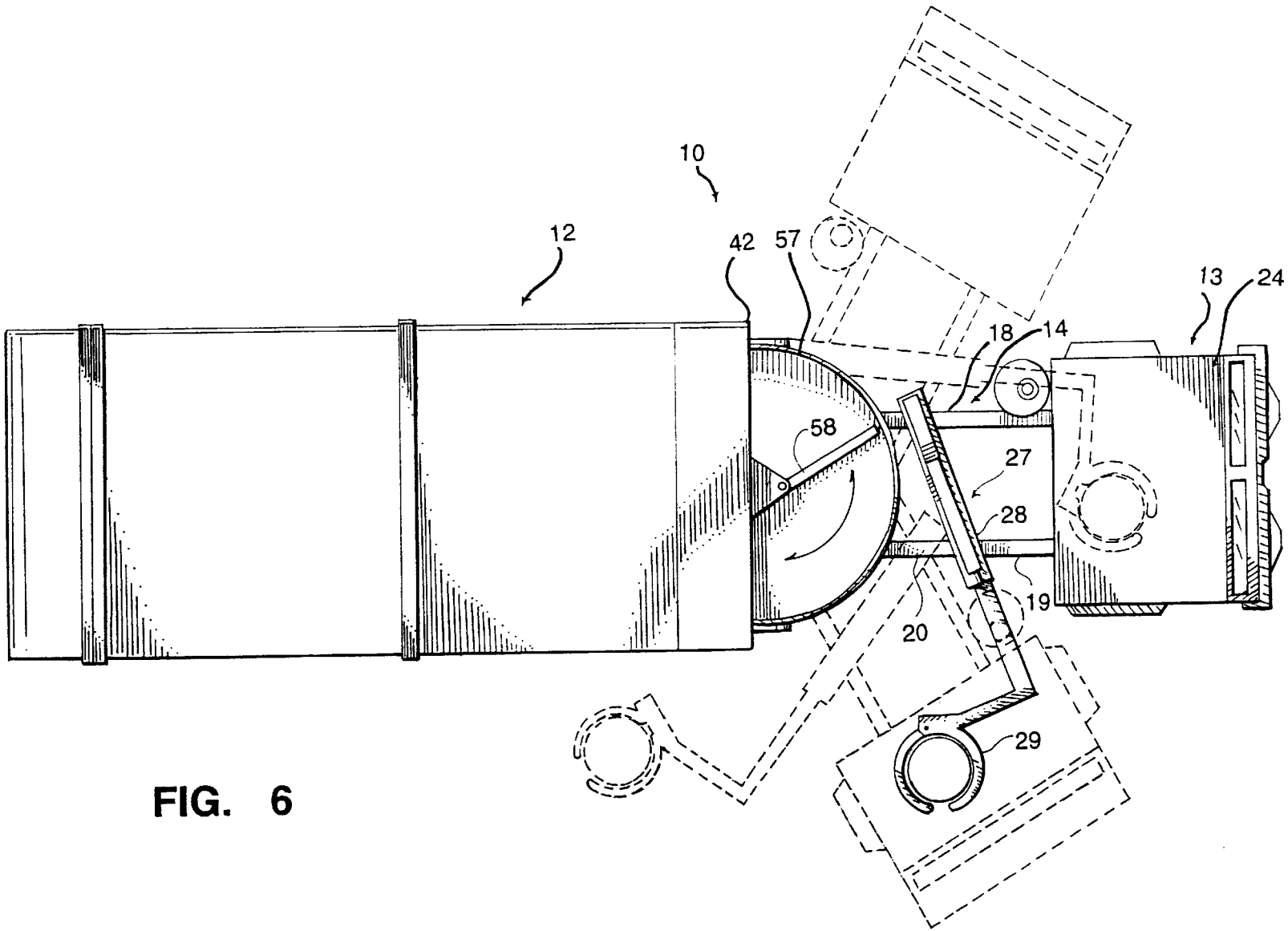
FIG. 6 is a top view illustrating the various positions of the collection tow vehicle pivotally coupled to the semi-trailer, showing the discharge of a refuse container into the hopper of the semi-trailer.

Referring now to FIG. 6, an articulated refuse vehicle 10 consisting of collection towing vehicle 13 and a semi-trailer 12 is illustrated. As can be seen by the broken lines, collection towing vehicle 13 may be pivoted about fifth wheel assembly 25, which was shown in FIG. 2 in relation to semi-trailer 12. The pivoting movement, allows for high maneuverability in a relatively large vehicle. Since refuse loading mechanism 27 discharges a refuse container in a substantially fixed location relative collection towing vehicle 13, the highly articulated nature of articulated refuse vehicle 10 may present a problem in discharging refuse into hopper 57. To overcome this problem, hopper 57 is centered generally over the king pin of coupling assembly 62, preferably with the pivot point of compactor 58 positioned approximately over the king pin. Refuse loading mechanism 27 is mounted, so that refuse is discharged on the general area of the king pin. Gripper member 29 and refuse loading mechanism 27, of which it is a part, are positioned so as to discharge refuse from refuse containers onto the area of the king pin. Since the distance between the king pin and refuse loading mechanism 27 does not vary regardless of the orientation of collection towing vehicle 13 with semi-trailer 12, and hopper 57 is positioned with the pivot point of compactor 58 over the king pin, refuse loading mechanism 27 will always discharge refuse from the refuse containers directly into hopper 57.

Figure 27:
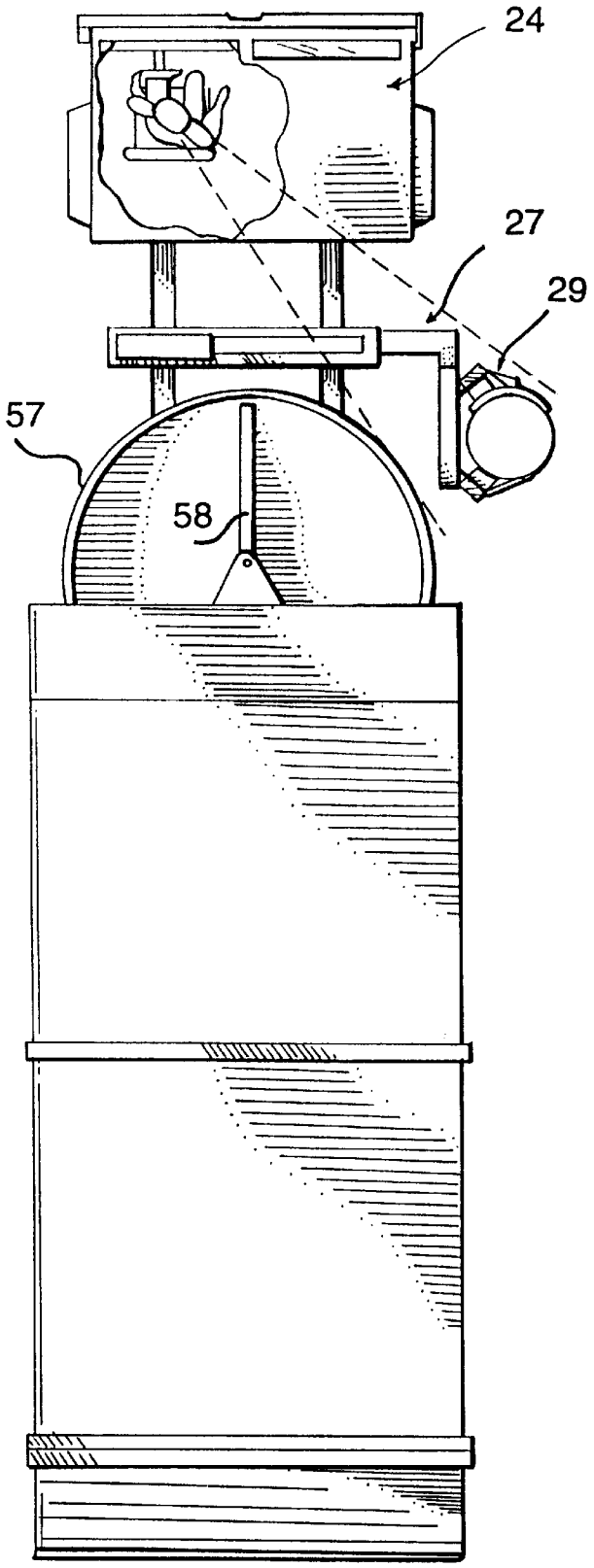
FIG. 27 is a top view of a refuse collection vehicle illustrating the operators visibility.

While a variety of hoppers with associated compactor mechanisms may be used, arcuate hopper 57 with a swinging platten 58 is preferred. Arcuate hopper 57 is preferred for reasons of increased visibility for the operator/driver, as can be seen with additional reference to FIG. 27. The operator/driver seated on the left or street side of cab 24 must be able to visually follow the operation of gripping member 29 of refuse loading mechanism 27 and the area about the refuse container to be gripped. The rounded off sides of arcuate hopper 57 permit a wider field of view for the operator/driver when a side mounted refuse loading mechanism, extending from the side opposite the operator/driver, is used. Using arcuate hopper 57 permits increased visibility when the highly articulated semi-trailer is in any of the numerous positions of which it is capable, as shown in FIG. 6.

Figure 31:
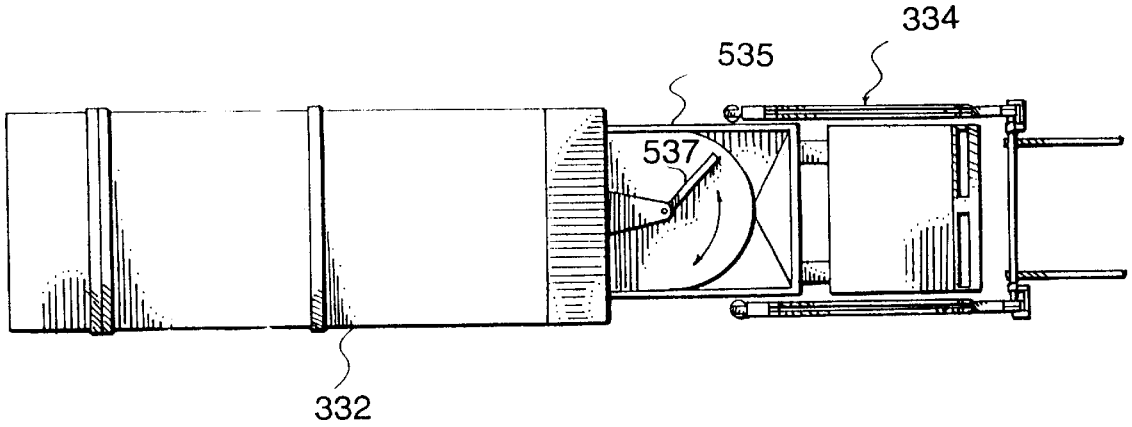
FIG. 31 is a top view of a refuse collection vehicle employing a swinging platten compactor and a front loading mechanism.

Arcuate hopper 57 using swinging platten 58, also allows continuous deposit of refuse into the hopper, without requiring the operator to wait for the compactor to complete its cycle before depositing refuse. This permits large volumes of refuse to be deposited into hopper 57 at one time. With additional reference to FIG. 31 a front loader mechanism 334, generally associated with depositing large volumes of refuse, is illustrated mounted on a conventional refuse vehicle 332 additionally equipped with an arcuate hopper 535 and rotating platten 537. Since rotating platten 537 operates in both directions, refuse can be continuously deposited into hopper 535 without causing jamming of the compactor mechanism. In conventional vehicles, when a large refuse container is being emptied into a hopper, the volume of refuse often exceeds the volume of the hopper. This circumstance requires partial emptying of the container, cycling the compactor, then completing the emptying of the refuse container. With rotating platten 537, the compactor mechanism is continuously cycling while the refuse is being deposited, permitting the refuse container to be completely emptied, even if the volume of refuse exceeds the volume of the hopper.

Figure 7:
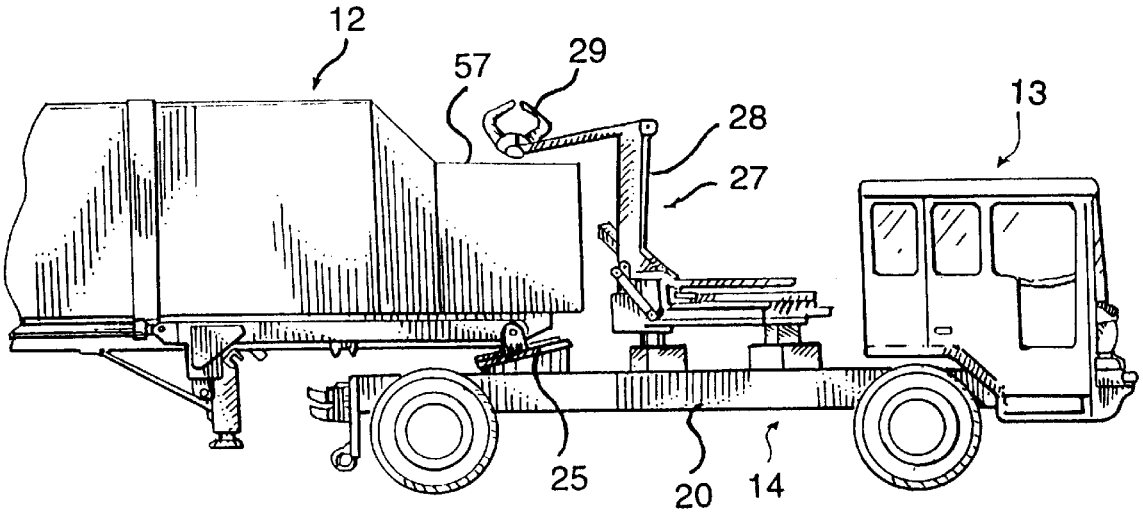
FIG. 7 is a partial side elevational view of a refuse collection vehicle consisting of a semi-trailer coupled to a collection tow vehicle.
Figure 8:
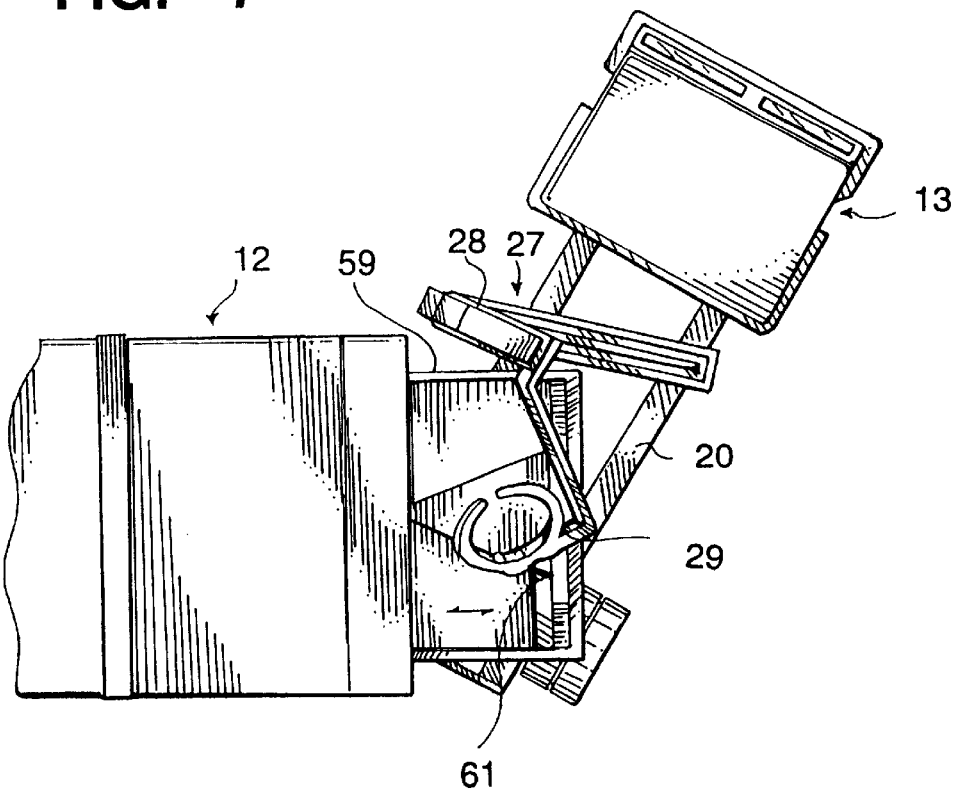
FIG. 8 is a side view of an alternate embodiment of the refuse collection vehicle illustrating use of the system with a conventional compacter mechanism in the hopper of the semi-trailer.

FIG. 7 illustrates the retraction of sidearm 28 to position gripper 29 of refuse loading mechanism 27 above hopper 57. FIG. 8 illustrates the use of a square hopper 59 with a reciprocating compacter 61, replacing arcuate hopper 57 with rotating compacter 58. Either one may be used since the refuse loading mechanism 27 is aligned to discharge refuse directly over the king pin which is positioned generally under the center region of the hopper.

Referring back to FIGS. 1 and 2, semi-trailer 12 further includes control assembly 30 consisting of control conduits formed into umbilical 32, carrying control medium to the various devices such as compacter 58 and hoist mechanism 60. Control assembly 30 as described above, includes female control coupling member 33 and male control coupling member 34 of control coupling assembly 35 at either end of umbilical 32. As can be seen in FIG. 2, male control coupling member 34 couples with female control coupling member 33 to supply the necessary control to semi-trailer 12 from collection towing vehicle 13. Further details of control coupling assembly 35 and the interaction between control assemblies 30 will be discussed below.

Figure 3:
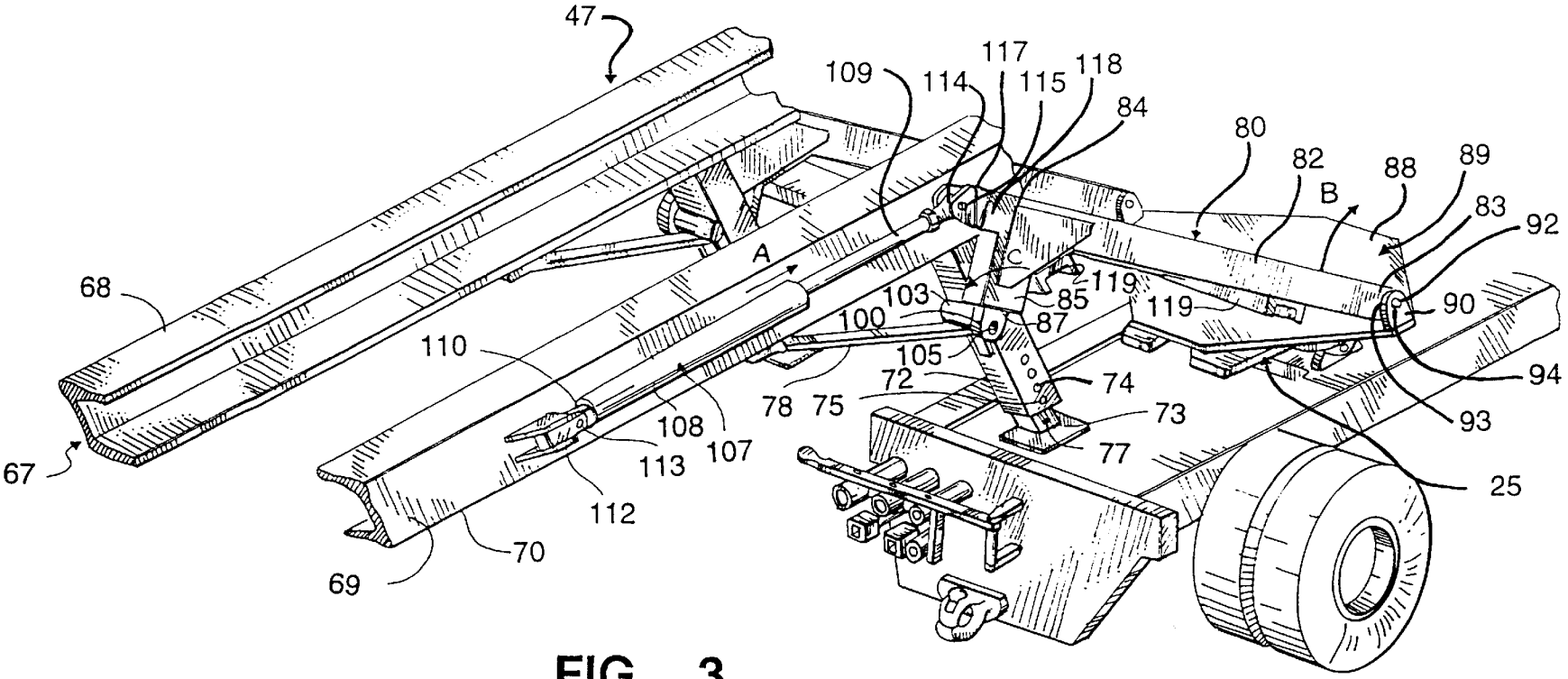
FIG. 3 is a partial perspective view of the hoist mechanism of the semi-trailer as it would appear coupled to a tow vehicle.

Referring now to FIG. 3, trailer frame 47 consists of parallel spaced apart longitudinal channel beams 67, having a top surface 68, an outer side surface 69, and a bottom surface 70, and landing gear 49. Frame 47 is coupled to collection tow vehicle 13 by hoist mechanism 60. Landing gear 49 each include a generally square tube 72, extending vertically downward from bottom surface 70 of channel beams 67. Adjustable legs 73 are received by square tubes 72 and are adjustably held in place by pins 74 extending through bores 75 formed in square tube 72 and corresponding bores in 77 in legs 73. The series of vertical tube bores 75 in square tube 72 allow legs 73 to be adjusted upward or downward as desired. This adjustability allows for use on varied fifth wheel heights and differing ground conditions. A strut 78 extends from square tube 72 rearward and upward, attaching to bottom surface 70 of channel beams 67.

Hoist mechanism 60 consists of parallel spaced apart generally L-shaped members 80 having horizontal main portions 82 with a terminal end 83 and a boss end 84. A vertical leg portion 85 depends downward from boss end 84 of generally L-shaped members 80 terminating in a terminal end 87. Terminal ends 83 of main portion 82 are pivotally coupled to opposing sides of a top surface 88 of a plate 89. A clevis connection pivotally couples terminal ends 83 to top surface 88 of plate 89. The clevis connections each consist of a bifurcated bracket 90 having inner and outer furcations spaced to receive terminal end 83 of main portion 82 therebetween. A bore 92 is formed through the furcations of bifurcated bracket 90 and a bore 93 is formed through terminal end 83 of main portion 82. A pin 94 is received by bores 92 and 93 thereby pivotally connecting main portion 92 to plate 89. A king pin (not shown) extends downward from plate 89, forming coupling assembly 62, for rotational engagement with fifth wheel assembly 25.

L-shaped members 80 are pivotally coupled to trailer frame 47 so as to be positioned to the outside of channel beams 67, parallel therewith in a lowered position. An attachment member 100 extends downward from terminal end 87 of vertical leg 85, and has a bore 102 formed therethrough. A socket 103 having a bore 104 is formed at the junction of strut 78 and square tube 72, and is configured to align with bore 102 of attachment member 100 to receive a pin 105. Pin 105 is journaled in bores 102 and 104 allowing pivotal movement between trailer frame 47 and L-shaped members 80.

Semi-trailer 12 is hoisted by pivoting trailer frame 47 and L-shaped members 80 at socket 103. The pivoting movement is achieved by a motor means, which in this embodiment is a hoist cylinder assembly 107 residing on outer side surfaces 69 of channel beams 67. Hoist cylinder assembly 107 includes a cylinder 108 and reciprocally moveable operating rod 109 which is extendable in response to the introduction of pressurized fluid into cylinder 108 in accordance with conventional practice. Cylinder 108 terminates at one end with an attachment member 110 pivotally secured to a bifurcated bracket 112 by a bolt and nut assembly 113. Bifurcated bracket 112 is affixed to outer side surface 69 of channel beams 67. Bifurcated bracket 112, in this embodiment, is attached to a flange extending from outer side surface 69 of channel beam 67. Although only one hoist cylinder assembly 107 is specifically seen in the drawings, it will be appreciated that a hoist cylinder assembly 107 resides on outer side surfaces 69 of each channel beam 67. Operating rod 109 terminates at the free end with eye 114. A boss 118 extends from boss end 84 of main portion 82 terminating in a bifurcated bracket 117 configured to receive eye 114 between furcations thereof. A nut and bolt assembly 115 extends through bifurcated bracket 117 and eye 114 pivotally securing reciprocating operating rod 109 to L-shaped members 80. For added stability and support, cross pieces 119 extend between L-shaped members 80.

With cylinder assembly 107 in the retracted position, L-shaped members 80 reside in a substantially horizontal orientation. In response to the introduction of pressurized fluid into cylinder 108, operating rod 109 is extended in the direction indicated by arrowed line A urging L-shaped member 80 to pivot upward about the axis provided by pins 94 as indicated by the arrowed line B. As reciprocating operating rod 109 continues to be extended, trailer frame 47 pivots about the axis provided by pin 105 as indicated by the arrowed line C, resulting in the forward end of frame 47 pivoting upward about rear wheels 48. Hoist cylinder assembly 107 pivots about the axis provided by nut and bolt assembly 113 in the direction indicated by the arrowed line D as seen in FIG. 2. As operating rod 109 is extended, trailer frame 47 pivots upward about the axis provided by rear wheels 48 as indicated by the arrowed line E.

When in the hoisted position, the refuse carried in refuse collection body 50 of semi-trailer 12 may be dumped out an opened tailgate assembly 55. The angle of bottom 52 is sufficient, when hoisted, to allow refuse to slide out without requiring any additional mechanism for ejecting it through the tailgate assembly.

Figure 9:
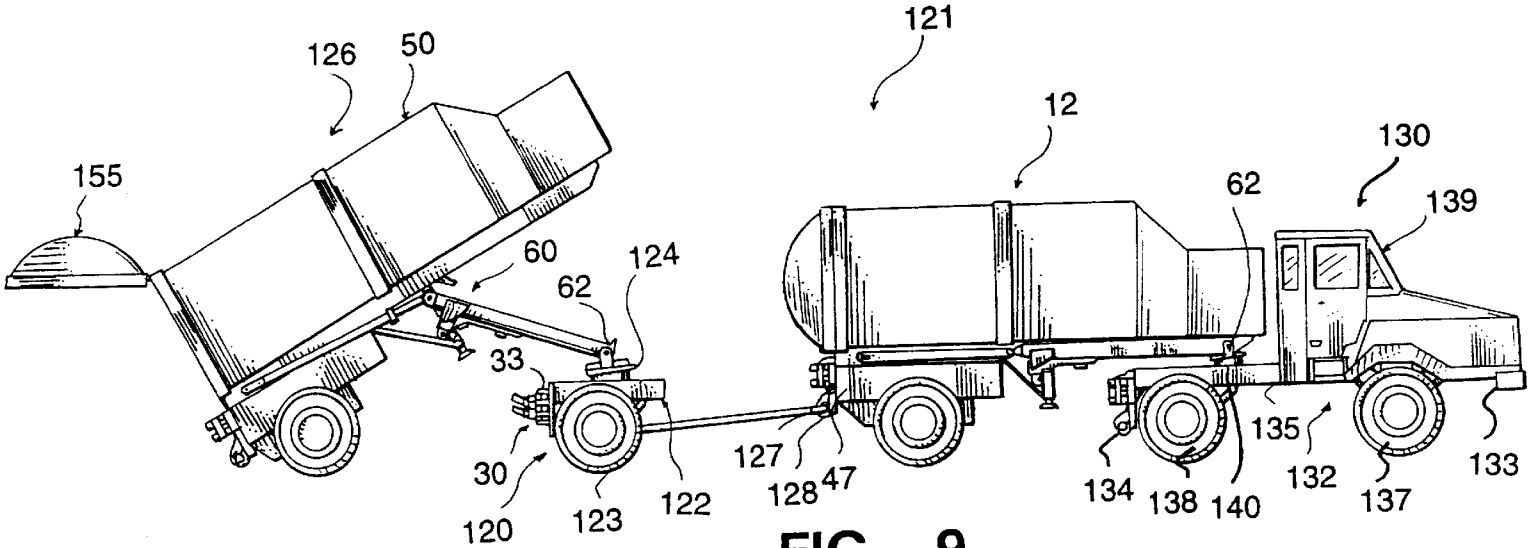
FIG. 9 is a side view illustrating a refuse collection vehicle consisting of tandem semi-trailers coupled together by a dolly and towed by a transport tow vehicle.

Alternatively, semi-trailer 12 may be coupled to a dolly 120 as illustrated in FIG. 9. Dolly 120 allows a towing vehicle to tow more than one semi-trailer 12, in a tandem configuration. The tandem configuration is illustrated in FIG. 9, which shows an alternate embodiment 121 of articulated refuse vehicle 10. Dolly 120 is coupled to the rearward end of trailer frame 47. Dolly 120 consists of a dolly frame 122 carried by a set of wheels 123. A fifth wheel assembly 124 is carried by frame 122 for rotational coupling with coupling assembly 62. Control assembly 30 consists of control conduits in an umbilical 32 having a female control coupling member 33 carried by the rearward end of frame 122, and a male control coupling element 34 projecting forward of frame 122. Control assembly 30 allows control media to be supplied to dolly 120 for control of a coupled semi-trailer 12. Dolly 120 may be coupled to a semi-trailer 12 or a towing vehicle, by a tow coupling assembly, which in this embodiment is preferably a pintle hitch consisting of a female element 127 extending from dolly frame 122 of dolly 120, and a male element 128 extending from frame 47 of semi-trailer 12.

Still referring to FIG. 9, it can be seen that a tow vehicle lacking a refuse loading mechanism 27, is towing semi-trailer 12 to which dolly 120 is coupled. The vehicle illustrated is a transport towing vehicle generally designated 130, which would be used to replace collection towing vehicle 13 for transport purposes. The use of transport towing vehicle 130 to transport semi-trailer 12 to a disposal site, frees collection towing vehicle 13 to use its specialized equipment, specifically refuse loading mechanism 27, to collect more refuse. Transport towing vehicle 130 consists of a chassis 132, which, for purposes of orientation throughout the ensuing discussion, is considered to have a forward end 133 and a rearward end 134. Chassis 132 includes a frame 135 supported above ground level by front wheels 137 and rear wheels 138. In accordance with conventional practice, front wheels 137, being steerable, provide directional control for the vehicle. Similarly, rear wheels 138, are caused to rotate in response to a conventional engine, transmission and drivetrain, not specifically illustrated, for propulsion of the unit. A cab 139, carried at the forward end 133 of frame 135, provides for an enclosed driver's compartment including the conventional controls associated with manipulation of chassis 132 in addition to the controls for operating the semi-trailers. A fifth wheel assembly 140, generally of a conventional configuration, is carried by frame 135 towards rearward end 134. Fifth wheel assembly 140 rotatably receives coupling assembly 62 of semi-trailer 12. Transport towing vehicle 130 also includes control assembly 63 (not shown) consisting of control umbilical 32 having female element control coupling member 33 and male control coupling member 34 element of control coupling assembly 35. Male element 128 of the tow coupling is attached to rearward end 134 of frame 135. This allows coupling of dolly 120 directly to transport towing vehicle 130. The reasons for these various coupling possibilities will be discussed in greater detail later in the specification.

Embodiment 121 of an articulated refuse vehicle, consists of transport towing vehicle 130 towing a first semi-trailer 12*a*, and a second semi-trailer 12*b*. Second trailer 12*b* is coupled to trailer 12*a* by a dolly 120. In this illustration, second semi-trailer 12*b* is illustrated with hoist mechanism 60 activated, tilting refuse collection body 50 into a dump position. Tailgate assembly 55 has been raised allowing refuse to be dumped. This illustration shows that semi-trailers 12 may be controlled and activated while attached to dollies 120 and illustrates that trailers may be discharged from either dollies 120 or vehicles such as 130 or 13.

Transport towing vehicle 130 may be substantially identical to collection towing vehicle 13, without refuse loading mechanism 27. Preferably, a transport towing vehicle 130 has a larger engine to facilitate hauling of large amounts of refuse over long distances. Collection towing vehicle 13 typically, has a smaller engine, reducing the cost of the vehicle, since only relatively short distances must be traversed, requiring less power. The numerous components described, form a refuse collection system which will be discussed in greater detail in the subsequent specification.

Figure 4:
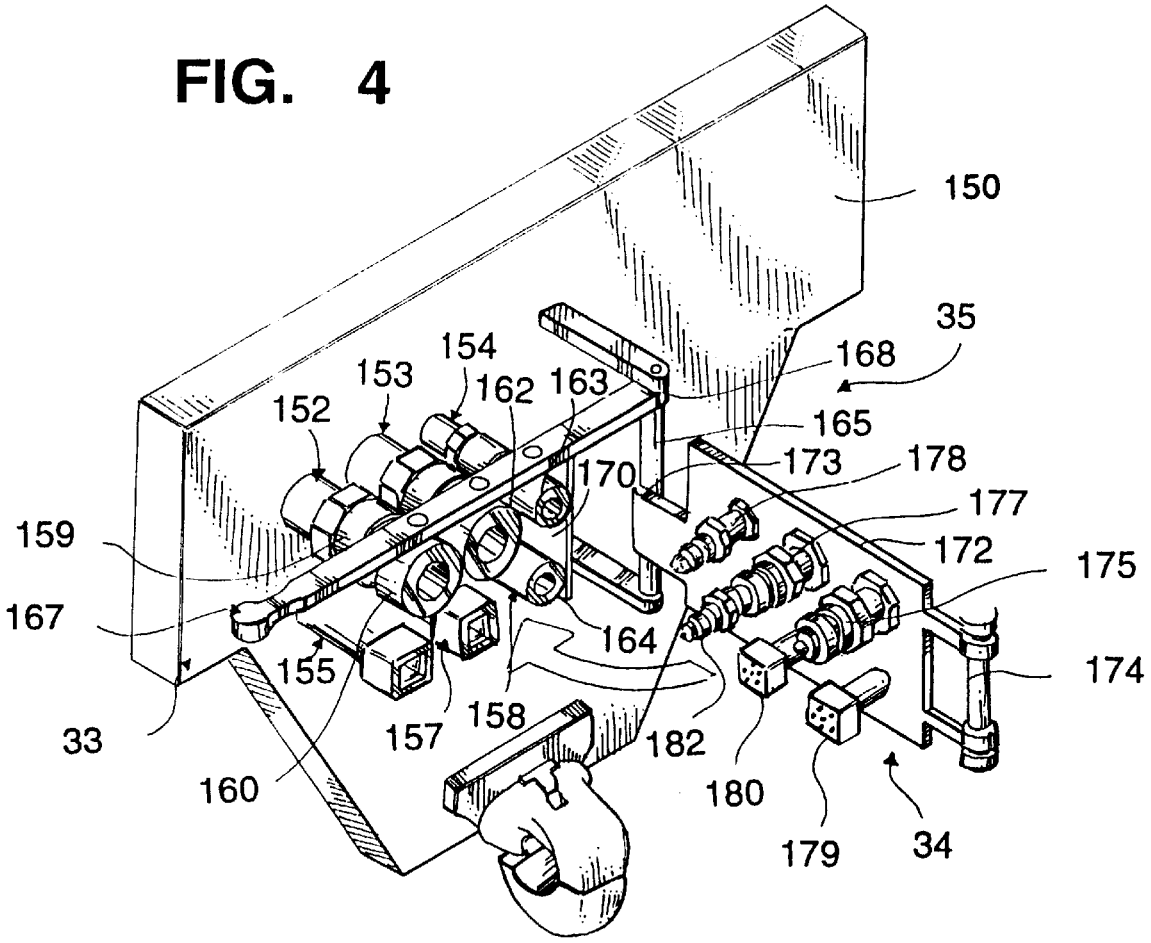
FIG. 4 is a perspective view of the male and female control coupling members of the control assembly.

Referring now to FIG. 4., control coupling assembly 35 of control assembly 30 is illustrated. Control coupling assembly 35 consists of female control coupling member 33 and male control coupling member 34. Female control coupling member 33 and male control coupling member 34 each consists of a plurality of quick couplings affixed to the respective ends of the conduits of the control umbilical 32.

Female control coupling member 33 consists of a plurality of female elements of quick couplings extending through an end plate 150 which fixes them in a closely grouped configuration. Female control coupling member are carried by the various vehicles, by attaching end plates 150 to rearward ends 17, 43, and 134 of frame 20, trailer frame 47, and frame 135 respectively. End plate 150 is also coupled to dolly frame 122 which in turn provides control to attached semi-trailer 12.

In this preferred embodiment, the grouping of the female elements of the quick couplings consist of a top row of three female elements, beginning on the left or street side with a hydraulic return female element 152, a hydraulic supply female element 153, and an air supply female element 154. A second row directly beneath the first row consists of an electric female element 155 for controlling lights, an electric control female element 157 for controlling various devices such as tailgate assembly 55, compacter 58, et. cetera, and an air brake female element 158. Female elements 152, 153, 154 and 158 may be any conventional quick disconnect couplings each consisting of a body 159 which receives a corresponding male element. Collars 160, 162, 163, and 164 are slideably coupled to bodies 159 of female couplings 152, 152, 154 and 158 respectively. These collars move along an axis of bodies 159, sliding inward to allow the insertion of the male elements, and subsequently sliding outward, locking them in place. Detailed description of the female elements have been omitted since they are conventional quick release couplings, and well known to those skilled in the art. It will also be understood by those skilled in the art that more or less female elements may be used, depending on the control required to be supplied by control umbilical 32.

A vertical rod 165 is coupled to end plate 150 in a spaced apart relationship adjacent the grouping of the female elements. A horizontal handle 167 having a pivot end 168 pivotally coupled to rod 165, extends horizontally above the grouping of female elements, and terminates in a grip 169. Handle 167 is coupled to collars 160, 162, and 163 of female elements 152, 153, and 154 respectively. A vertical segment 170 depends from handle 167 proximate pivot end 168, and couples to collar 164 of female element 158. Handle 167 is pivoted inwardly, towards end plate 150 to simultaneously slide collars 160, 162, 163, and 164 back, allowing insertion of the male elements.

Male control coupling member 34 of control coupling assembly 35 consists of a plate 172 holding a plurality of male elements in a grouping which corresponds to the grouping of the female elements. A flange 173 acting as a temporary hinge, extends from an edge of plate 172 for removable engagement with rod 165 of female control coupling member 33. A handle 174 extends from an edge opposite flange 173. A top row of male elements, beginning from the handle edge, includes a hydraulic return male element 175, a hydraulic supply male element 177, and an air supply male element 178. A bottom row includes an electric male element 179, an electric control male element 180, and an air brake male element 182.

To couple male control coupling member 34 to female control coupling member 33, flange 173 is pivotally engaged with rod 165. Plate 172 is pivoted inwardly toward female control coupling member 133 around the axis of rod 165. Simultaneously, handle 167 is pivoted inwardly sliding collars 160, 162, 163, and 164 inward allowing insertion of the corresponding male elements. Handle 167 is then pivoted outward locking the male elements in place. Male control coupling 34 is removed from female control coupling member 33 with a reversal of these steps.

Figure 5:
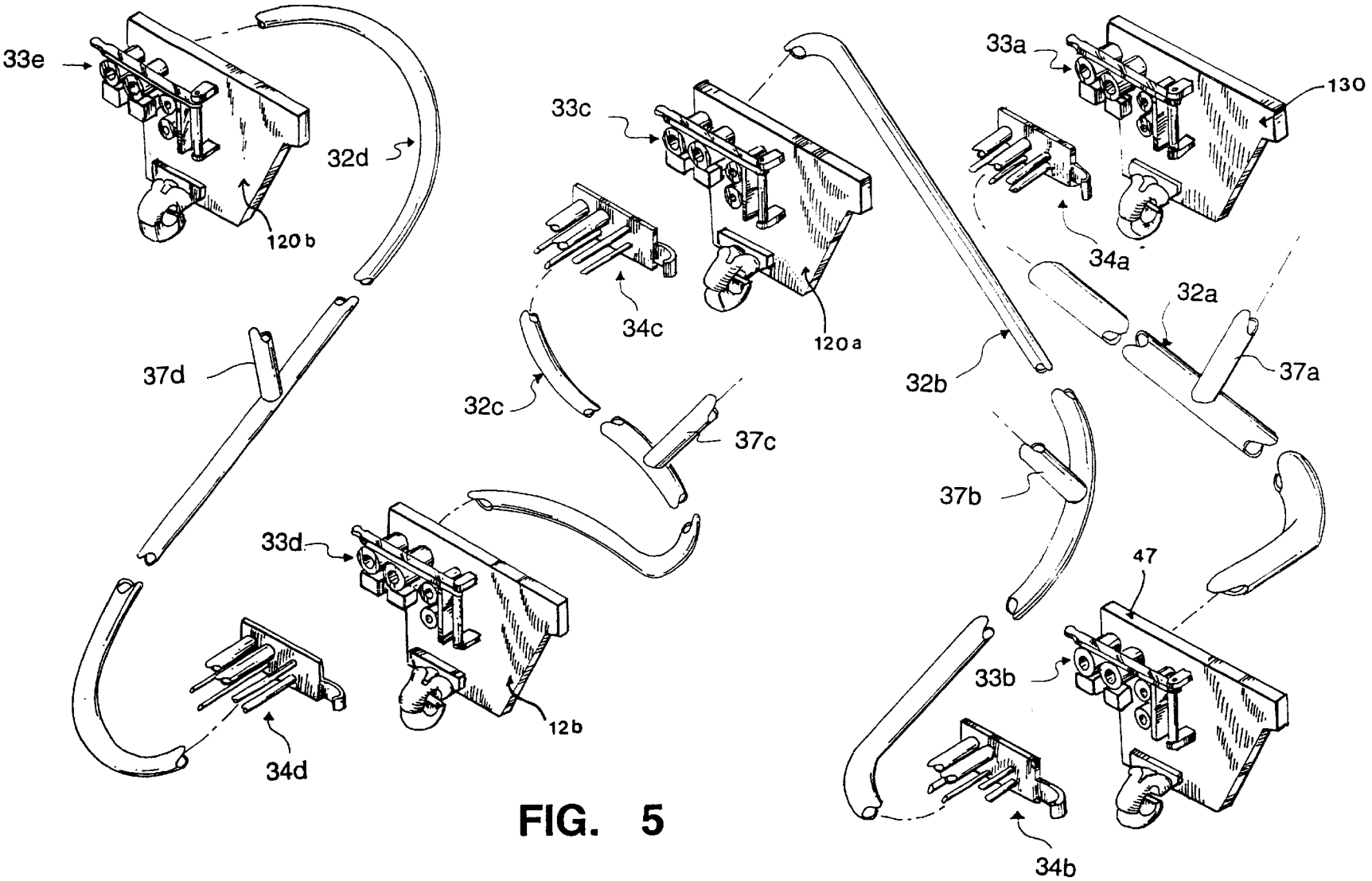
FIG. 5 is a partial view of the interconnections of the control assemblies of a refuse collection vehicle.

Referring now to FIGS. 5 and 9, a control system for use on an articulated refuse vehicle 121 is illustrated. It will be understood that a similar set-up would be used on articulated refuse vehicle 10. In this preferred embodiment, articulate d re fuse vehicle 121 consists of transport towing vehicle 130, a first semi-trailer 12*a*, a first dolly 120*a*, a second semi-trailer 12*b*, and a second dolly 120*b*, which, while not allowable in this country may be allowable for towing additional trailers in other countries. It will be understood that while a transport towing vehicle 130 is described in this embodiment, it may be replaced with collection towing vehicle 13.

A female control coupling member 33*a* is shown coupled to the rearward end 134 of transport towing vehicle 130. A male control coupling member 34*a* couples a control umbilical 32*a* of semi-trailer 12*a* to transport towing vehicle 130. Control umbilical 32*a* terminates in a female control coupling member 33*b* coupled to rearward end 43 of trailer frame 47. A feeder conduit 37*a* splits off from control umbilical 32*a*, to provide control media to various mechanisms in semi-trailer 12*a*. This would include supplying electricity for lights, electricity to the hydraulic controls, hydraulic fluid to the various hydraulic mechanisms such as the compacter, and hoist, and air for the brakes.

A male control coupling member 34*b* attached to the end of a control umbilical 32*b* is coupled to female control coupling 33*b*, thereby supplying control media to first dolly 120*a*. Control umbilical 32*b* terminates in a female control coupling member 33*c* coupled to dolly frame 122. A feeder conduit 37*b* extends from control umbilical 32*b*, supplying air to the brakes, and electricity to the brake lights of dolly 120*a*.

A male control coupling member 34*c* couples a control umbilical 32*c* of a second semi-trailer 12*b* to female control coupling member 33*c* of dolly 120*a*. Control umbilical 32*c* terminates in a female control coupling member 33*d* coupled to rearward end 43 of trailer frame 47. A feeder conduit 37*c* extends from control umbilical 32*c* supplying the necessary control media to the various mechanisms discussed earlier.

A male control coupling member 34*d* may be used to couple a control umbilical 32*d* of a second dolly 120*b* to female control coupling member 33*d* of second semi-trailer 12*b*. Control umbilical 32*d* terminates in a female control coupling member 33*e* coupled to dolly frame 122. A feeder conduit 37*d* extends from control umbilical 32*d* to provide the necessary control media, in this case air and electrical power, to the mechanisms of dolly 120*b*. It will be understood by those skilled in the art that various alternate configurations may be employed, with the illustrated configuration supplied solely for purposes of illustration and clarification of the coupling in control of the various elements of an articulated refuse vehicle 10.

Figure 10:
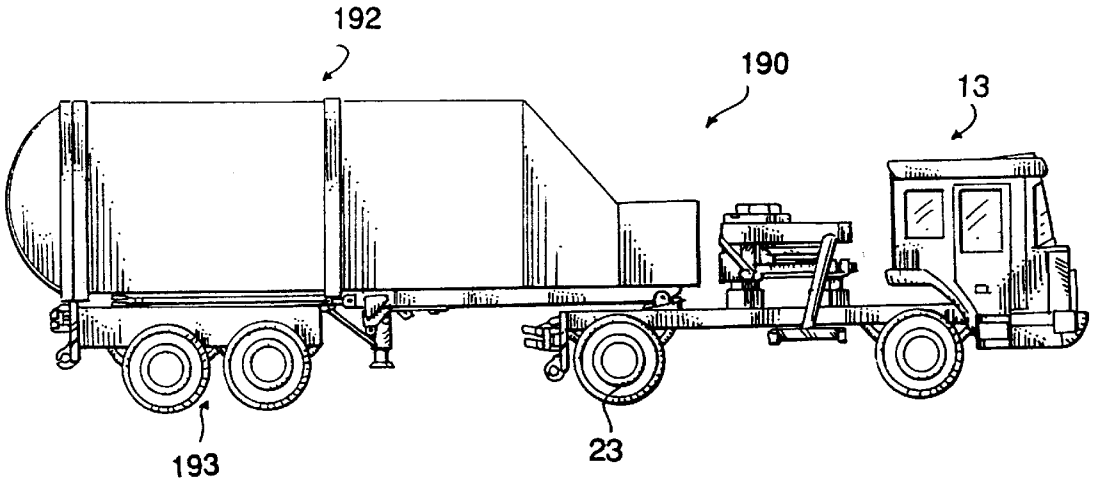
FIG. 10 is a side view illustrating a large double axle semi-trailer coupled to a collection tow vehicle.

FIG. 10 illustrates a further embodiment generally designated 190 of an articulated refuse vehicle consisting of a single, double axle trailer 192. Semi-trailer 192 is substantially identical to semi-trailers 12, with increased dimensions, and a double axle 193 to support heavier loads. Semi-trailer 192 is hauled by a collection towing vehicle 13 as described above. Semi-trailer 192 may be dimensioned to carry a volume of approximately 50 cubic yards. It may have a payload of approximately 15 tons. For many haulers, 15 tons is a days work for collecting and hauling. Since the wheel base from rear wheels 23 of collection towing vehicle 13 to the double axle 193 of semi-trailer 192 is about the same as for a conventional 30 cubic yard body mounted on a conventional truck chassis, the combination is at least as maneuverable, due to the articulation, with one and one half times the payload capacity.

Embodiment 121 illustrated in FIG. 9 shows the use of two semi-trailers 12, each of which may have a ten ton payload. The legal limit on the highways in the United States is 80,000 pounds if the distance between the extreme axles, that is front wheels 137 of transport towing vehicle 130 and rear wheels 48 of second semi-trailer 12, is 51 feet or more according to current regulations.

The previously described elements may be combined to form a refuse collection system which would, in the preferred embodiment, include a plurality of semi-trailers 12, collection tow vehicles 13, transport tow vehicles 130 and dollies 120.

The initial collection of refuse would be accomplished by combining a semi-trailer 12 with a collection towing vehicle 13. When the collection towing vehicle 13 fills semi-trailer 12, collection towing vehicle 13 would exchange loaded semi-trailer 12 with an empty semi-trailer 12 at a predetermined transfer site. While collection towing vehicle 13 continues to perform its designed function of collecting refuse, a transfer towing vehicle 130 would transport the loaded semi-trailer 12 to a distant disposal site. To reduce the number of trips required of transport towing vehicle 130, a dolly 120 may be coupled to the back of a first loaded semi-trailer 12*a* for towing an additional semi-trailer 12*b*. This double trailer rig, as illustrated in FIG. 9 and discussed above, would transport the refuse to a distant disposal site, where the second semi-trailer 120 would be emptied. Semi-trailer 120 may be emptied by opening tailgate assembly 55, and activating hoist mechanism 60 to tilt refuse collection body 50 upwards. The refuse contained in refuse collection body 50 would slide out and be deposited in the disposal site. The control assembly 35 which was discussed earlier in the specification, allows for the dumping of the second trailer off dolly 120. Refuse collection body 50 is then lowered, and tailgate assembly 55 closed. Dolly 120 is uncoupled from first semi-trailer 12*a*, which is then dumped in an identical manner. Dolly 120 with its coupled semi-trailer is recoupled to first semi-trailer 12*a* and transported back to a collection area for refilling.

It will be understood by those skilled in the art, that various alternate combinations of the previously described elements may be employed. For example, for relatively short distances to disposal sites, a collection towing vehicle 13 may be used to tow semi-trailer 12 to a disposal site. Also, a collection towing vehicle 13 may work a collection area by itself with a first semi-trailer 12*a* and a second semi-trailer 12*b* and a dolly 120. In this example, second semi-trailer 12*b* and dolly 120 would be left at a site, near the route while first semi-trailer 12*a* is filled. Upon return to the site, first semi-trailer 12*a* is exchanged with second semi-trailer 12*a*, which, is filled. Upon returning to the site, again semi-trailers 12*a* and 12*b* are coupled in tandem for towing to a transfer site for transfer to transport towing vehicle 130 or transported by collection towing vehicle 13 to a disposal site.

Alternate embodiments of various elements may also be provided, to ensure the necessary service to each individual community. Different communities have different requirements for refuse collection and disposal, and a refuse collection system must be flexible to accommodate these variations.

Figure 11:
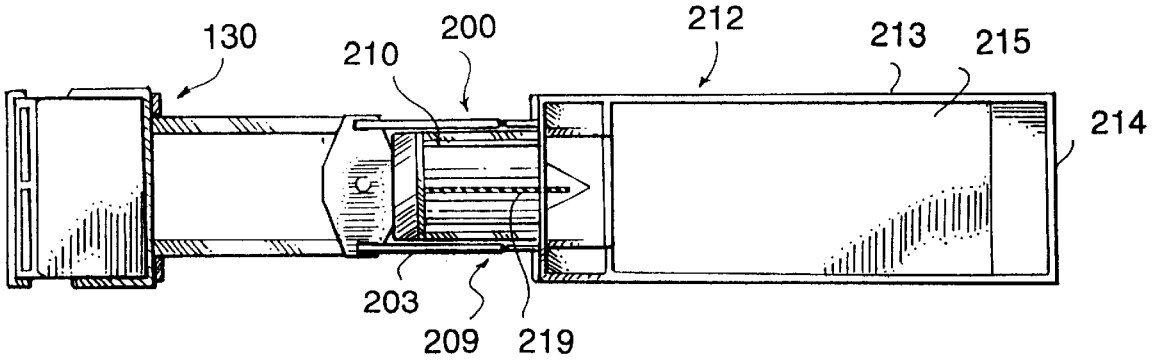
FIG. 11 is a top view illustrating an additional component of a refuse collection system, showing a roll-off semi-trailer coupled to a transport tow vehicle.
Figure 12:
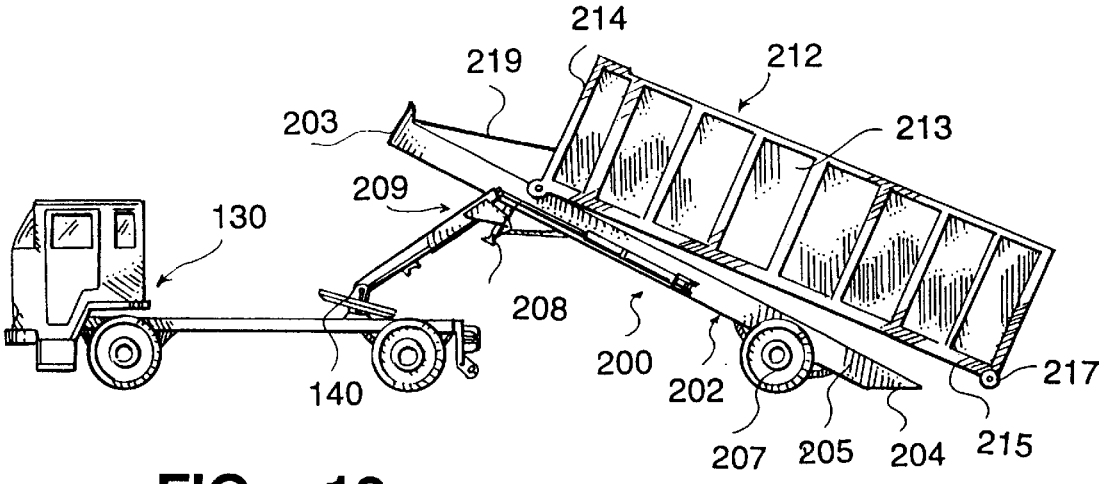
FIG. 12 illustrates the refuse collection vehicle of FIG. 11 with a roll-off semi-trailer hoisted to the tilt position for positioning a roll-off container.
Figure 13:
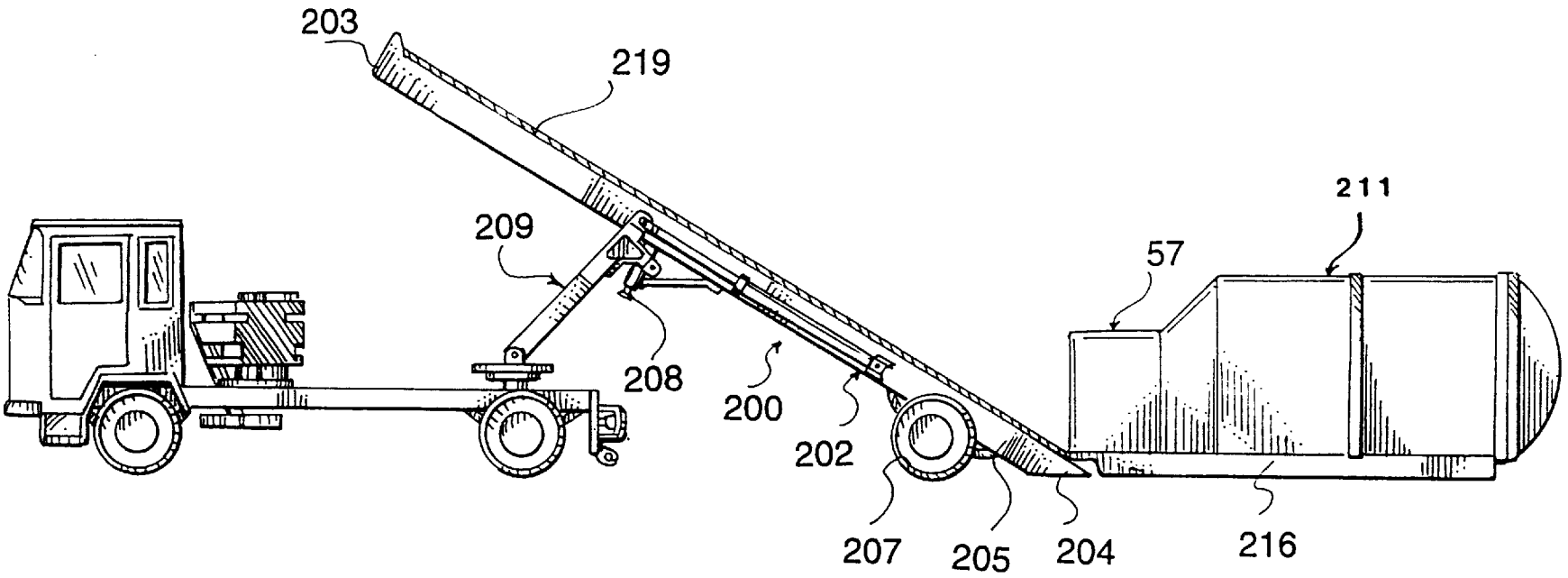
FIG. 13 illustrates a refuse collection vehicle similar to that illustrated in FIGS. 11 and 12 with a roll-off semi-trailer hoisted to the tilt position for positioning a removable refuse collection body.

Referring to FIGS. 11, 12 and 13, an alternate embodiment of a semi-trailer generally designated 200 is illustrated. Semi-trailer 200 consists of a trailer chassis 202 having a forward end 203 and a rearward end 204. Chassis 202 includes a frame 205 supported by rear wheels 207 located at rearward end 204, and landing gear 208 located approximate forward end 203. A hoist mechanism 209, substantially identical to hoist mechanism 60 described above, couples frame 205 to fifth wheel assembly 140 of transport towing vehicle 130. A rail assembly 210 is carried by frame 205, to receive a large roll off refuse container 212 as shown in FIGS. 11 and 12, or a removable refuse collection body 211 as shown in FIG. 13. Refuse container 212 is a generally rectangular container having sidewalls 213, endwalls 214 and a bottom 215. Wheels 217 are carried by bottom 215 and are receivable on rail assembly 210. Removable refuse collection body 211 consists of a refuse collection body 50 and a hopper 57, as described previously in connection with FIGS. 1 and 2, mounted upon a frame 216. A winch assembly 218, not visible, coupled to chassis 202, aids in loading and unloading container 212 and removable refuse collection body 211.

To load container 212 or removable refuse collection body 211 onto semi-trailer 200, hoist mechanism 209 is activated, tilting frame 205 upward. A cable 219 is coupled from winch assembly 218 to container 212 or removable refuse collection body 211. Wheels 217 of container 212 and frame 216 of removable collection body 211, are received by rail assembly 210 and pulled gradually upward along rail assembly 210 by winch assembly 218. Once container 212 or removable refuse collection body 211 is fully winched onto rail assembly 210, hoist mechanism 209 is lowered. A filled container 212 or removable refuse collection body 211 may now be transported to a disposal site, or delivered empty to a new location.

Semi-trailer 200 may be used in combination with semi-trailers 12, and carried by dollies 120. It may be emptied by tilting hoist mechanism 209 attached to either dolly 120 or a vehicle such as 130. This allows the refuse collection system to be tailored to a community which requires large containers for dumping bulk refuse or a community which desires one vehicle capable of carrying a variety of items for different uses, such as removable refuse collection body 211.

Figure 14:
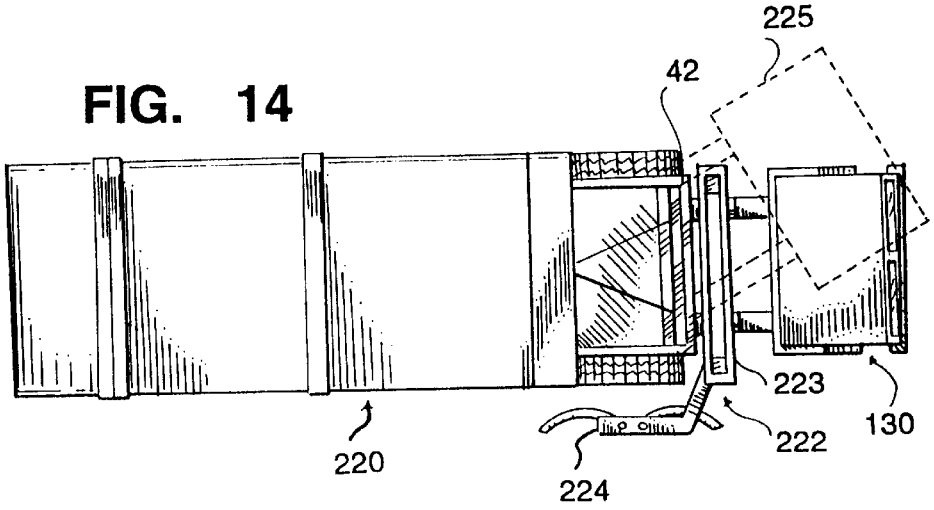
FIG. 14 is an alternate embodiment of a refuse collection vehicle consisting of a semi-trailer having a sidearm loader, coupled to a transport tow vehicle.

Referring now to FIG. 14, a semi-trailer designated 220 is illustrated. Semi-trailer 220 includes a trailer chassis 40 a refuse collection body 50, a hopper 57, and a hoist mechanism 60 as previously described for semi-trailer 12. While generally analogous to semi-trailer 12, the immediate embodiment 220 differs by virtue of a refuse loading mechanism 222. Refuse loading mechanism 222 consisting of a sidearm 223 terminating in a gripper 224 is coupled to forward end 42 of trailer chassis 40. Semi-trailer 220 would be used in combination with a transport towing vehicle 130. Since refuse loading mechanism 222 is coupled to semi-trailer 220 the orientation of transport towing vehicle 130 may vary as shown by dotted line 225, and not disturb the functioning of refuse loading mechanism 222.

Referring now to FIGS. 21 and 22, a semi-trailer designated 230 is illustrated. Semi-trailer 230 includes a trailer chassis 40 a refuse collection body 50, a hopper 57, and a hoist mechanism 60 as previously described for semi-trailer 12. While generally analogous to semi-trailer 12, the immediate embodiment 230 differs by virtue of a front loading mechanism 232. Front loader 232 consists of pair of horizontal arms 233 and 234, coupled in a spaced apart relationship at a pivotal end 235 by a transverse rod 236 extending therebetween, and a terminal end 238. A pair of vertical members 239 and 240 are pivotally coupled to terminal ends 238 of horizontal arms 233 and 234 respectively, depending downward forward of cab 139 and terminating in terminal ends 242. Horizontal fork members 243 and 244 extend forward from terminal ends 242 of vertical members 239 and 240, and are pivotally coupled thereto. Horizontal fork members 243 and 244 are configured to engage a conventional front loader refuse container (not shown) in a conventional manner. A transverse rod 245 extends between terminal ends 242 of vertical members 239 and 240, carrying and coupling horizontal fork members 243 and 244 in a parallel spaced apart relationship. A pair of cylinders 247 coupled between terminal ends 242 of vertical members 239 and 240 and transverse rod 245 pivot horizontal fork members 243 and 244 upward for dumping the refuse container.

Cylinders 248 are coupled between forward end 42 of refuse collection body 50 and pivotal ends 235 of horizontal arms 243 and 244 for pivotal movement upward in a conventional dumping motion as illustrated by broken lines 249. A more detailed description of front loading mechanism 232 has been omitted since the previously discussed elements are conventional and well known to those skilled in the art.

The improvements to front loading mechanism 232 consists of horizontal arms 233 and 234 each consisting of a first segment 250 and a second segment 252 telescopingly received therein. A pair of extension cylinders 253 are coupled between first and second segments 250 and 252 of horizontal arms 233 and 234. Extension cylinder 253 extends second segment 252 forward relative first segment 250 moving horizontal fork members 243 and 244 in a generally forward direction. Front loading mechanism 232 is coupled to curb side 45 of refuse collection body 50 proximate forward end 42. Front loading mechanism 232 is pivotally coupled by a pivot post 254 extending downward from pivotal end 235 of horizontal arm 233 to be journaled in a socket 255 formed in refuse collection body 50. A pivot cylinder 257 is coupled between refuse collection body 50 and pivot post 254 approximate pivotal end 235 of horizontal arm 233. Retraction of pivot cylinder 257 results in front loading mechanism 232 pivoting horizontally in the direction of curb side 45, as illustrated by broken lines 258. Extension of pivot cylinder 257 returns front loading mechanism 232 to a forward orientation for dumping. The coupling between terminal ends 238 of horizontal arms 233 and 234, and vertical members 239 and 240, is illustrated in FIG. 23.

Figure 23:
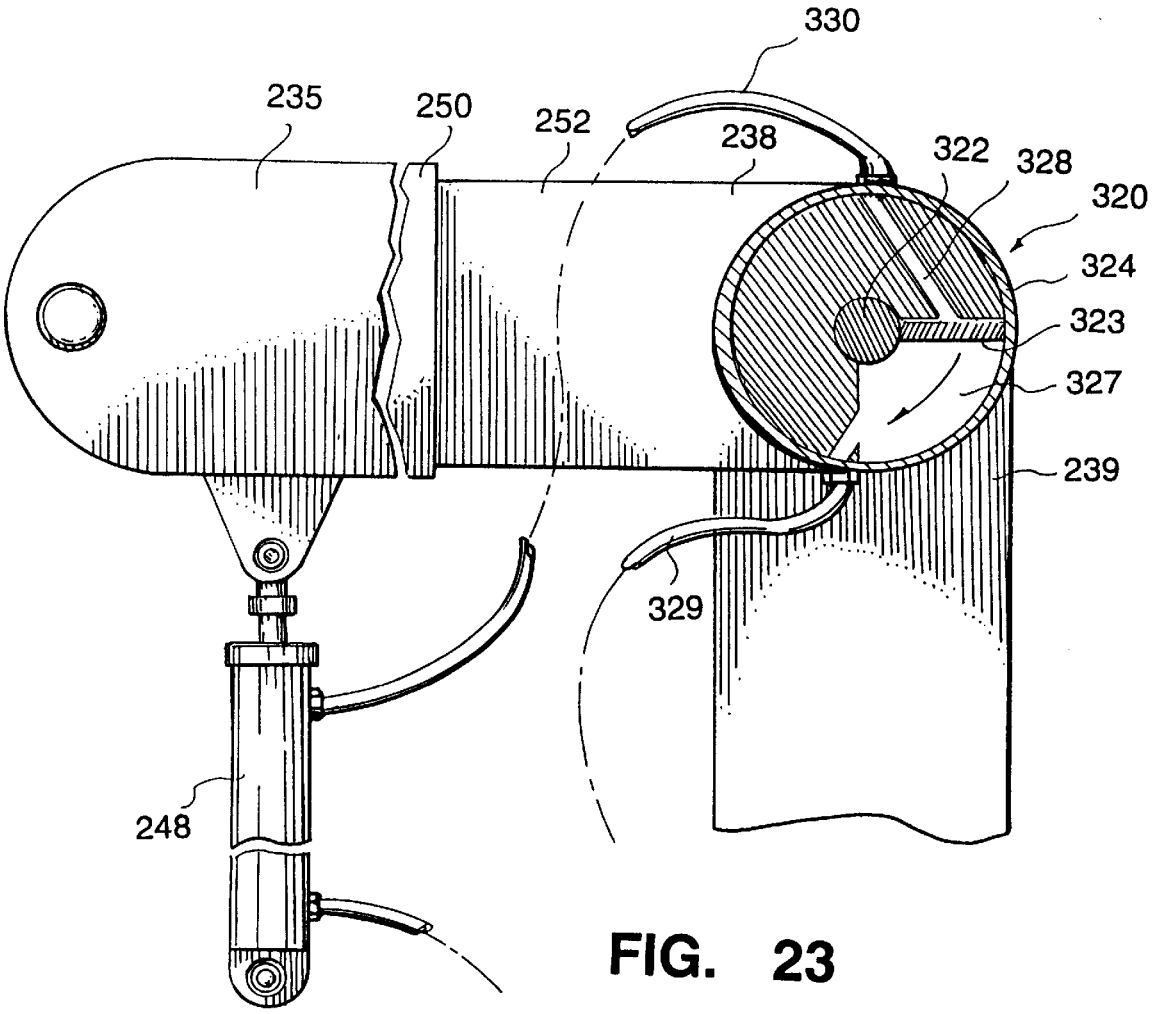
FIG. 23 is an enlarged cut-away sideview of the hydraulic motor used in the lift mechanism illustrated in FIGS. 21 and 22.

FIG. 23 illustrates a motor, which in this embodiment is a hydraulic motor 320, which pivots vertical members 239, 240 from a rest position, to a dump position illustrated by broken line 249 in FIG. 21. Hydraulic motor 320 consists of a shaft 322 associated with the end of vertical arm 239. Shaft 322 is equipped with a vane 323 extending therefrom. Shaft 322 and vane 323 are enclosed by a housing 324 attached to terminal end 238 of horizontal arm 233. Housing 324 has a cavity divided into two portions 327, 328 by vane 323. A first hose 329 supplies and exhausts hydraulic fluid from portion 327 and a second hose 330 supplies and exhausts fluid for portion 328. As fluid is injected into one of portions 327,328, fluid is exhausted from the other portions 327, 328. The fluid pushes against vane 323 rotating shaft 322 resulting in pivoting of vertical portions 239. Hoses 329 and 330 are coupled to opposing ends of cylinder 248. When cylinder 248 is extended, fluid is forced through hose 330 into portion 328. When cylinder 248 is retracted, fluid is forced through hose 329 into portion 327, and exhausted through hose 330. Those skilled in the art will understand that a similar hydraulic motor is employed between terminal end 238 of horizontal arm 234 and vertical member 240.

Front loading mechanism 232 is capable of pivoting around a vertical axis provided by pivot post 254, in order to engage a container to the curb side of the semi-trailer. Front loading mechanism 232 pivots independent with respect to the orientation of the tow vehicle. The pivotal feature of front loading mechanism 232 allows engagement with refuse containers not directly in front of semi-trailer 230. However, front loading mechanism 232 must be pivoted to the forward position before dumping to ensure discharge of the entire load into hopper 57.

Figure 15:
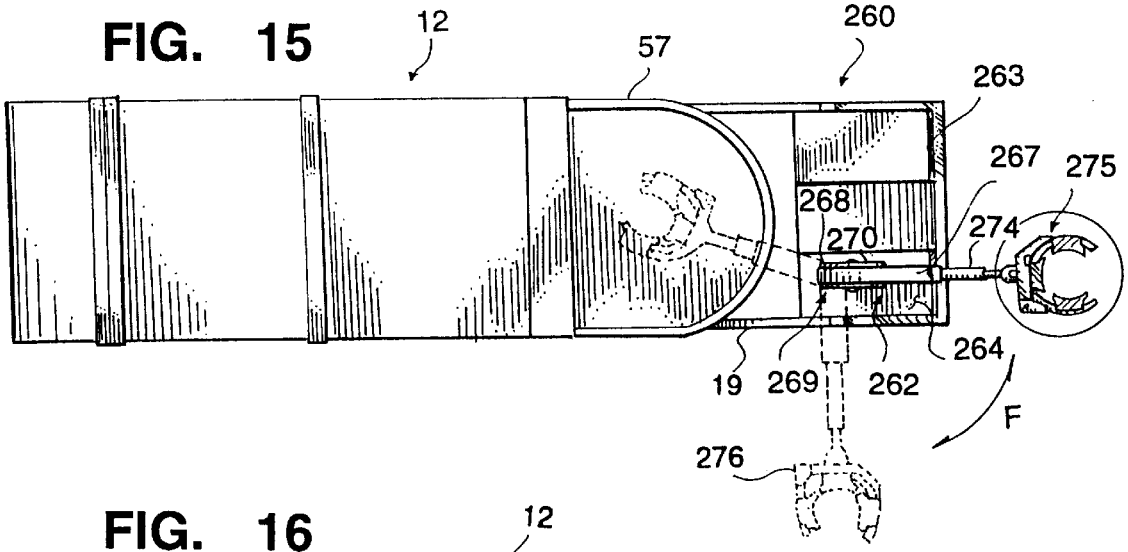
FIG. 15 illustrates an alternate embodiment of a refuse collection vehicle showing a semi-trailer coupled to a collection tow vehicle having a pivotal loading arm capable of replacing conventional front loading vehicles.
Figure 16:
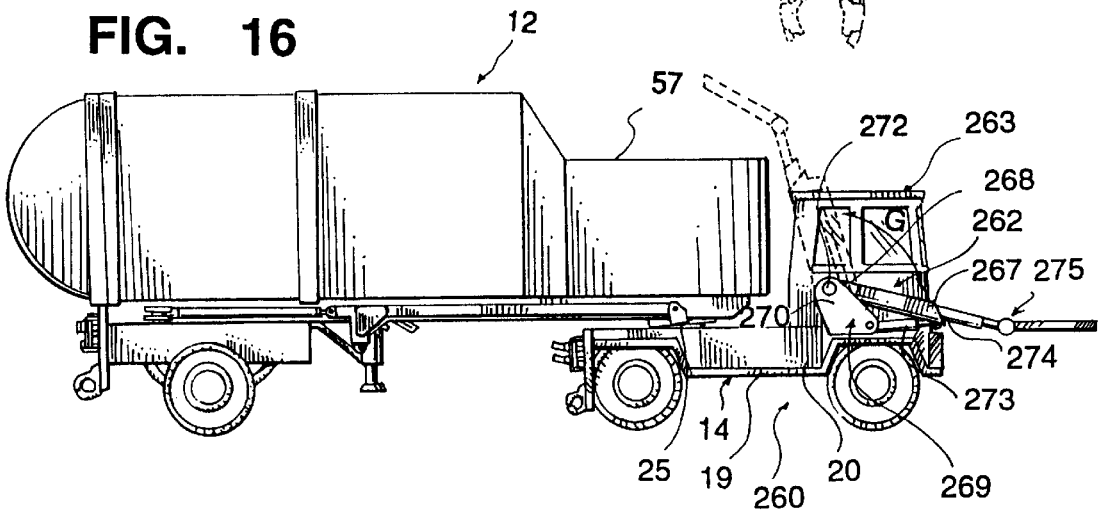
FIG. 16 is a side view of the refuse collection vehicle illustrated in FIG. 14 showing the dumping action of the pivotal loading arm.

Referring now to FIGS. 15 and 16, an alternate embodiment of a collection towing vehicle generally designated 260 is illustrated. Collection vehicle 260 is substantially similar to collection towing vehicle 13, including a chassis 14 a frame 20 and a fifth wheel assembly 25. While generally analogous, the immediate embodiment 260 differs by virtue of a pivotal loader arm 262 mounted adjacent a cab 263 in a space 264 defined by cab 263 and curb side 19 of frame 20. Pivoting loader arm 262 consists of an arm 267, which is telescopingly extendable, having a pivot end 268, pivotally attached to a clevis fitting 269 for pivotal movement in a vertical direction. Clevis fitting 269 consists of a bifurcated bracket 270 pivotally mounted to frame 20 in space 264. Bifurcated bracket 270 rotates horizontally, swinging pivoting loader arm 262 in an arch, illustrated by arrowed line F. Horizontal rotation is achieved by motor means, which may be any conventional rotary or reciprocating drive mechanism, positioned beneath space 264 and not visible. A pin 272 extends through bifurcated bracket 270 and pivot end 268 of arm 267. A pivot cylinder 273 coupled between clevis fitting 269 proximate frame 20 and a terminal end 274 of arm 267, pivots arm 267 about the axis provided by pin 272 as indicated by the arrowed line G. A lifting attachment 275 is coupled to terminal end 274 of arm 267.

As can be seen in FIGS. 15 and 16, lifting attachment 275 of pivoting loader arm 262 may engage a refuse container in a forward direction or at intermediate locations around to the side as illustrated by broken line 276. To empty the refuse container into hopper 57, pivoting loader arm 262 must be rotated until it is directed in a substantially forward direction, to ensure deposit of refuse into hopper 57. Pivoting loader arms such as 262 are familiar to those skilled in the art.

Referring to FIGS. 17 and 18, an alternate embodiment 280 of lifting attachment 275 is illustrated. Lifting attachment 280, consists of a gripping member 282 and an attachment member 283 extending therefrom. Attachment member 283 is a collar which receives terminal end 274 of arm 267. Nut and bolt assemblies 284 extend through attachment member 283 and terminal end 274, securely fastening lifting attachment 280 to arm 267. Gripping member 282 consists of a first gripping arm 285 having a base portion 287 from which attachment member 283 extends substantially perpendicularly. Base portion 287 has an end 288 and an interior gripping surface 289. First arm 285 further includes a curved portion 290 extending from base portion 287 opposite end 288, having an interior gripping surface 292. A gripping member 293 having an end 294 pivotally coupled to end 288 of arm 285 opposes curved portion 290. A hydraulic cylinder 295 or other actuating means, is coupled between base portion 287 and gripping member 293 proximate end 294 for movement of gripping member 293 towards curved portion 290 for gripping a refuse container, and away from curb portion 290 for releasing a refuse container. Gripping member 293 has a curved interior gripping surface 297 which opposes interior gripping surface 292 of curved portion 290. Interior gripping surfaces 289, 292, and 297 define an interior circumference which is variable by the pivotal movement of gripping member 293. This interior space is sufficiently large to accommodate refuse containers of approximately 300 gallon capacity.

Removable surfaces 298 consisting of brackets 299 and contact surfaces 300 may be attached to interior gripping surfaces 289, 293 and 297, to reduce the interior diameter. With removable surfaces 298 in place, smaller refuse containers having a capacity of approximately 90 gallons may be accommodated.

Gripping member 282 is controlled by hydraulics in a conventional manner. Hoses 302 extending along arm 267 are removably coupled to cylinder 295.

If the larger conventional steel commercial containers need to be collected, a further embodiment 303 of lifting attachment 275 illustrated in FIGS. 19 and 20 may be attached to terminal end 274 of arm 267. Lifting attachment 303 consists of parallel tines 304 coupled in a parallel spaced apart relationship by a cross member 305. An attachment member 307 substantially identical to attachment member 283 of embodiment 280 extends back from cross member 305 for engagement with terminal end 274 of arm 267. Since arm 267 extends from cab 263 in a laterally displaced location towards the curb side, attachment member 307 extends from cross member 305 intermediate tines 304 offset towards one side preferably curb side.

Lifting attachment 303 employs tines 304 which engage a conventional steel commercial container 308 by insertion of tines 304 through brackets 309 affixed thereto in a conventional manner.

A further embodiment of an articulated refuse vehicle, generally designated 410 is illustrated in FIG. 24. Articulated refuse vehicle 410 includes many of the same elements as previous embodiments, including a semi-trailer 412 and a collection towing vehicle 413. Collection towing vehicle 413 includes a chassis 414, which, for purposes of orientation in the ensuing discussion, is considered to have a forward end 415, and a rearward end 417. Chassis 414 includes a frame 420 supported above ground level by front wheels 422 and rear wheels 423. A cab 424, carried at forward end 415 of chassis 414 provides for an enclosed driver's compartment. A fifth wheel assembly 425 is carried at rearward end 417 of frame 420. Fifth wheel 425 as mentioned prior, may be any conventional design well known to those skilled in the art, used in association with a semi-trailer.

Figure 28:
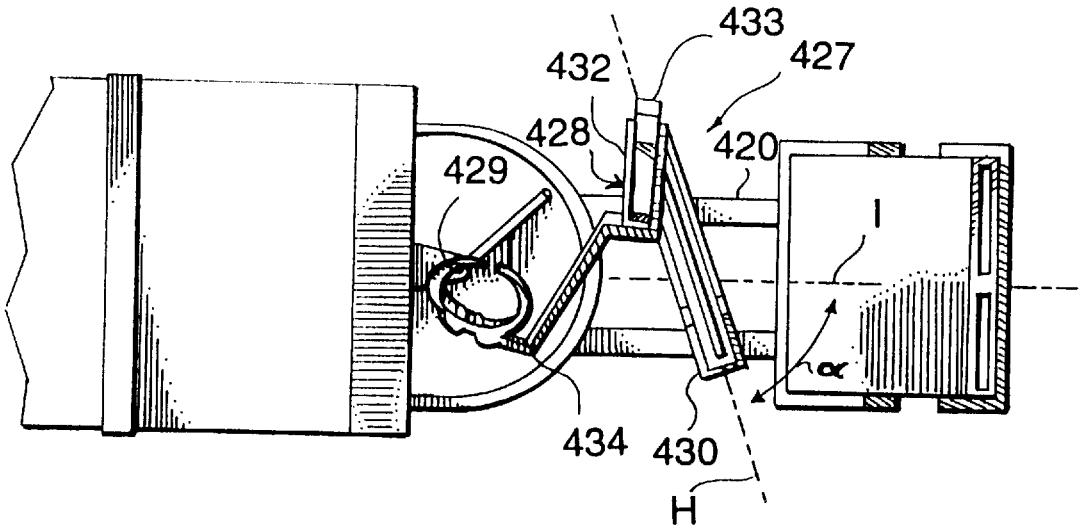
FIG. 28 is a partial top view illustrating a skewed loader.

A refuse loading mechanism generally designated 427 is carried by frame 420 intermediate cab 424 and fifth wheel assembly 425. In this embodiment, refuse loading mechanism 427 consists of an extendable sidearm 428 terminating in a gripping member 429. With additional reference to FIG. 28, refuse loading mechanism 427 includes a base 430 coupled to frame 420 and a boom 432 having a first end 433 pivotally coupled to base 430 and a second end 434 coupled to gripping member 429. Base 430 is coupled to frame 420 in a skewed manner. In other words, base 430, having a longitudinal axis H, extends across frame 420 with longitudinal axis H transverse to the longitudinal axis, designated I, of frame 420, at an oblique angle a. The skewed mounting of refuse loading mechanism 427 permits a chassis having a short wheelbase to be used. The position of sidearm 428 must be changed to accommodate rear wheels 423 as they are moved forward.

Figure 29:
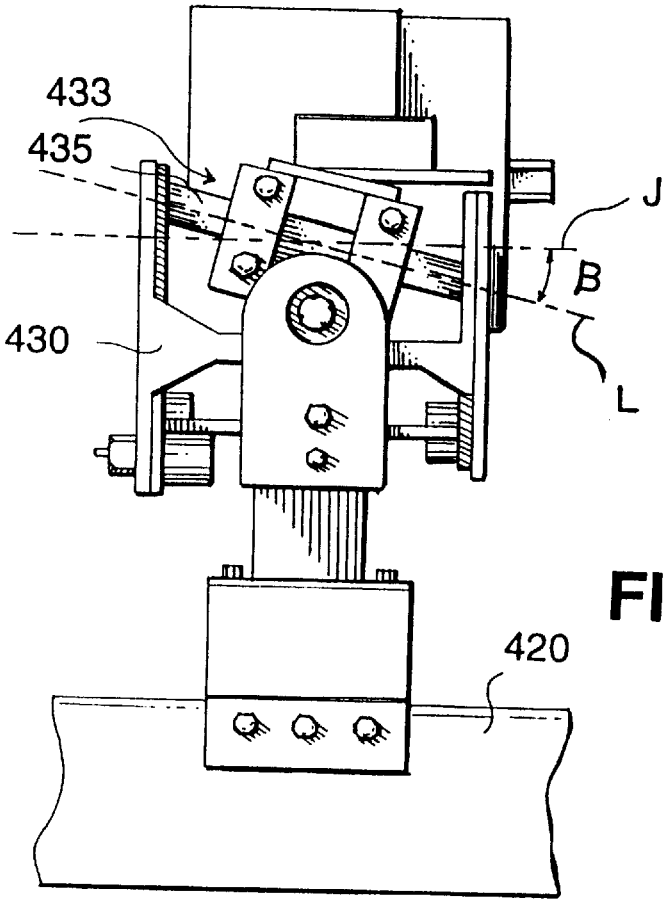
FIG. 29 is an enlarged end view of the skewed pivot of the skewed loader.

The pivotal connection between first end 433 of boom 432 and base 430 may also be skewed, causing gripping member 429 to move rearward as boom 432 rises. FIG. 29 illustrates the pivotal connection between boom 432 and base 430. A horizontal plane, parallel to base 430 is designated J. First end 433 of boom 432 is pivotally coupled to base 430 by a coupling member 435 having an axis L about which boom 432 pivots. Axis L is skewed in relation to horizontal plane J, forming an oblique angle b therewith. In the stored or travel position, boom 432 is forward, generally aligned with base 430. This keeps gripping member 429 forward of rear wheels 423 even when a short wheelbase is used. During the discharge of a refuse container, as boom 432 rises, the skewed pivot results in the refuse container rising away from base 430 toward semi-trailer 412. A detailed description of refuse loading mechanism is omitted since those skilled in the art will understand that various different types and designs of refuse loading mechanisms may be altered and mounted on frame 420 in this manner.

Figure 30:
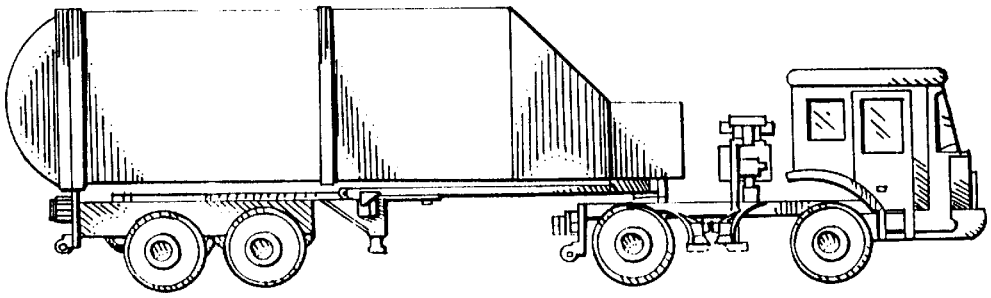
FIG. 30 is a side view of an articulated refuse collection vehicle employing a fender stored refuse loading mechanism.

As described, various different refuse loading mechanisms may be employed. An example of one such loading mechanism is illustrated in FIG. 30 and described in U.S. Patent entitled Refuse Container Gripping Apparatus U.S. Pat. No. 4,461,607, herein incorporated by reference. This apparatus stores gripping members in a vertical plane as opposed to a horizontal plane. In this manner the gripping members avoid the wheels of the refuse collection vehicle.

Referring back to FIGS. 24–27, semi-trailer 412 includes a trailer chassis 440, which, for purposed of orientation is considered to have a forward end 442, and a rearward end 443. Trailer chassis 440 includes a frame 447 supported above ground level by rearwheels 448 and a coupling assembly 449 removably engagable with fifth wheel 425.

A refuse collection body, generally designated by the reference character 450 is carried upon chassis 440. Refuse collection body 450 is a hollow refuse receiving and storage receptacle. An arcuate hopper 457 is formed integral with the forward portion of refuse collection body 450 proximate forward end 442. Refuse, received by hopper 457 from refuse loading mechanism 427, is moved from hopper 457 to the storage receptacle by a rotating compacter mechanism, not shown.

Refuse 459 may be discharged from a refuse collection body in different ways. Disclosed previously was a hoist mechanism 60, which raised the forward end of the body, the refuse sliding out the rearward end. In this embodiment, refuse collection body 450 includes a walking floor 460. Walking floor 460 includes a plurality of parallel slats 462 which are movable between retracted and extended positions. In operation, walking floor ejects refuse by moving slats 462 to an extended position. Slats 462 are extended about one foot, moving the refuse a corresponding one foot. With reference to FIG. 25, it can be seen that the refuse has been moved from its original position indicated by broken line 463 to a position approximately one foot towards the rearward end of refuse collection body 450. Slats 462 are then retracted in sets. For example, sets consisting of every third slat are retracted in series, until all slats 462 are in the retracted position. The process is then repeated, with all of slats 462 extended and the sets retracted in series. FIG. 26 illustrates refuse from a position indicated by broken line 464 to a position approximately one foot towards the rearward end of refuse collection body 450. This process is repeated until the refuse is ejected out the rearward end of refuse collection body 450.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A method of collecting refuse comprising the steps of:

moving a plurality of semi-trailers, each having a frame carrying a refuse collection body, to a transfer site;

successively and individually coupling said plurality of semi-trailers to a fifth wheel of at least one vehicle;

depositing refuse into said refuse collection body of each of said plurality of semi-trailers, after each of said plurality of semi-trailers has been individually coupled to the fifth wheel of the at least one vehicle, using a loading mechanism carried by one of the semi-trailers and the at least one vehicle;

storing the plurality of loaded semi-trailers at said transfer site; and transporting said plurality of semi-trailers containing collected refuse to a disposal site.

2. A method as claimed in claim 1 wherein the step of depositing refuse into said semi-trailer includes the steps of:

engaging a refuse container with said loading mechanism; and discharging said refuse container into a hopper of said refuse collection body.

3. A method as claimed in claim 2 wherein the step of depositing refuse into said semi-trailer further includes the steps of moving said refuse from said hopper to a storage receptacle of said refuse collection body.

4. A method as claimed in claim 3 further includes a step of emptying each of said plurality of said semi-trailers after the step of transporting said plurality of semi-trailers containing collected refuse to a disposal site.

5. A method as claimed in claim 4 wherein said step of emptying further includes the steps of:

opening a tailgate assembly closing said storage receptacle of said refuse collection body;

extending a hoist mechanism;

retracting said hoist mechanism; and closing said tailgate assembly.

6. A method as claimed in claim 1 wherein the step of transporting said semi-trailers containing refuse further comprises the steps of:

attaching one of said plurality of semi-trailers to a dolly; and coupling said dolly to another of said plurality of semi-trailers coupled to said vehicle.

* * * * *